United States Patent [19]

Tsubouchi et al.

[11] Patent Number: 4,684,754

[45] Date of Patent: Aug. 4, 1987

[54] WORKING FLUID FOR TRACTION DRIVE

[75] Inventors: Toshiyuki Tsubouchi; Hitoshi Hata, both of Sodegaura, Japan

[73] Assignee: Idemitsu Kosan Company Limited, Tokyo, Japan

[21] Appl. No.: 931,431

[22] Filed: Nov. 14, 1986

[30] Foreign Application Priority Data

Nov. 29, 1985 [JP] Japan ..... 60-268961
Dec. 23, 1985 [JP] Japan ..... 60-287882

[51] Int. Cl.[4] ..... C07C 13/605; C10M 1/02

[52] U.S. Cl. ..... 585/21; 252/9; 252/73; 585/20; 585/268; 585/360

[58] Field of Search ..... 585/20, 21, 268, 360; 252/9, 73

[56] References Cited

U.S. PATENT DOCUMENTS 4,521,324 6/1985 Tsubouchi et al. ..... 585/21
4,525,290 6/1985 Tsubouchi et al. ..... 585/21
4,556,503 12/1985 Tsubouchi et al. ..... 585/21
4,604,492 8/1986 Shimizu et al. ..... 585/21
4,604,493 8/1986 Shimizu et al. ..... 585/21
4,609,481 9/1986 Tsubouchi et al. ..... 585/21

FOREIGN PATENT DOCUMENTS 0135871 4/1985 European Pat. Off. ..... 585/20
2123849 2/1984 United Kingdom ..... 252/73
2130600 6/1984 United Kingdom ..... 585/268

*Primary Examiner*—Asok Pal
*Attorney, Agent, or Firm*—Walter H. Schneider

[57] ABSTRACT

The working fluid for traction drive comprises (A) a compound having, in a molecule, two decahydronaphthalene rings bonded either directly to each other or to the same or different carbon atoms in an alkane molecule or a compound having, in a molecule, one decahydronaphthalene ring and one cyclohexane ring bonded either directly to each other or to the same carbon atom in an alkane molecule and (B) a compound having two cyclohexane rings bonded either to the terminal carbon atoms of a $C_{2-3}$ alkane molecule or to the carbon atoms of cyclopentane. The working fluid has a high traction coefficient with stability over a wide range of temperature, especially, in low temperatures.

10 Claims, 26 Drawing Figures

WORKING FLUID FOR TRACTION DRIVE

BACKGROUND OF THE INVENTION

The present invention relates to a working fluid for traction drive or, more particularly, to a working fluid for traction drive comprising two kinds of specific compounds as the principal ingredients and capable of exhibiting excellent performance of traction drive.

A working fluid for traction drive generally means a fluid used in traction drive apparatuses, i.e. frictional drive apparatuses utilizing rolling contact, such as continuously variable transmissions for automobiles and industrial machines, hydraulic machines and the like. Working fluids for traction drive are required to have a high traction coefficient and stability against heat and oxidation in addition to inexpensiveness.

In recent years, studies on traction drive apparatuses are directed to the reduction of size and weight mainly in consideration of those mountable on automobiles. Correspondingly to this trend, the requirements for the working fluid for traction drive in these apparatuses are also escalating to have performance capable of withstanding various severe conditions under which the apparatuses are used. In particular, a working fluid for traction drive is required to exhibit high performance with stability over a wide temperature range from low temperatures, e.g. −30° C., to high temperatures, e.g. 120° C., including a high traction coefficient, relatively low viscosity, high oxidation stability and so on.

Various types of working fluids have been developed hitherto although none of them can satisfy all of the above mentioned requirements leaving problems in one or more respects. For example, a compound having a high traction coefficient as a working fluid at high temperatures usually has a high viscosity so that the efficiency of power transmission therewith is low due to the large agitation loss in addition to the problem in starting the traction drive apparatus at low temperatures. A compound having a relatively low viscosity and a high efficiency of power transmission, on the other hand, usually has a low traction coefficient at high temperatures and may cause troubles in the lubrication of the traction transmission apparatus due to the unduly decreased viscosity of the fluid at high temperatures.

SUMMARY OF THE INVENTION

Accordingly, the present invention has an object to provide a novel working fluid for traction drive free from the above described problems and disadvantages in the conventional fluids for traction drive and capable of exhibiting excellent performance in a wide range of temperatures. The inventors have undertaken extensive investigations with the above mentioned object based on an idea that excellent overall performance of a fluid for traction drive would be obtained when a compound having a high traction coefficient at high temperatures is admixed with a compound having a relatively low viscosity and arrived at a discovery that a mixture of specific compounds of these two types can exhibit a synergistic effect of the compounds with a greatly increased traction coefficient over a wide range of temperatures.

Thus, the working fluid for traction drive of the present invention established as a result of the above mentioned discovery comprises:

(A) a first compound selected from the class consisting of
- (A-1) bis(decahydronaphthalene) compounds having two decahydronaphthalene rings in a molecule directly bonded to each other,
- (A-2) alkane compounds having two decahydronaphthalene rings in a molecule bonded to one and the same carbon atom of the alkane,
- (A-3) alkane compounds having two decahydronaphthalene rings in a molecule bonded to two carbon atoms of the alkane adjacent to each other,
- (A-4) alkane compounds having a decahydronaphthalene ring and a cyclohexane ring in a molecule bonded to one and the same carbon atom of the alkane, and
- (A-5) cyclohexyl decahydronaphthalene compounds; and (B) a second compound selected from the class consisting of
- (B-1) alkane compounds having a main chain of two or three carbon atoms, to which at least two methyl groups are bonded, and having two cyclohexane rings in a molecule each bonded to one of the terminal carbon atoms of the alkane, and
- (B-2) cyclopentane compounds having two cyclohexane rings in a molecule, as the principal constituents, the fluid having a kinematic viscosity of at least 3 centistokes at 100° C.

In particular, the fluid of the invention should preferably contain from 10 to 900 parts by weight of the component (B) per 100 parts by weight of the component (A).

DETAILED DESCRIPTION OF THE PREFERRED EMBODIMENTS

Figure 1:
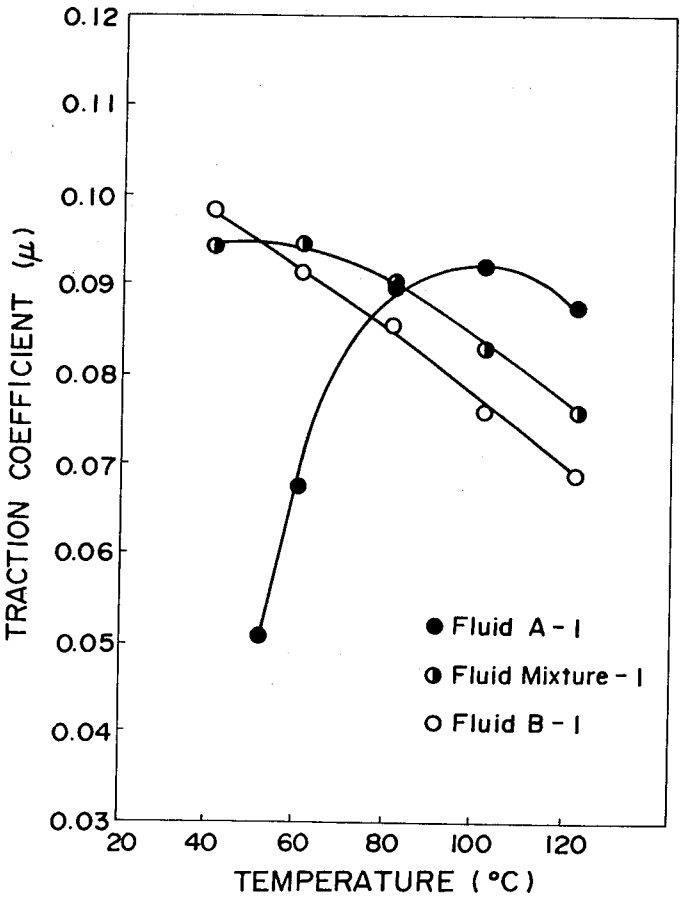
FIGS. 1, 3, 5 and 7 are each a graphic showing of the traction coefficient vs. temperature relationship of the fluid prepared in one of the examples and comparative examples.

As is understood from the above given summary, the working fluid for traction drive of the invention comprises the components (A) and (B) in combination as the principal ingredients. Each of the components (A) and (B) is selected from the class consisting of several types of compounds. Namely, the component (A) is selected from the class consisting of five types of the compounds including (A-1) to (A-5) defined above. The compounds belonging to the types of (A-1) to (A-3) each have two decahydronaphthalene rings bonded in different ways. The compound of the type (A-1) is a bis(decahydronaphthalene) compound having two decahydronaphthalene rings directly bonded to each other. The compounds of the types (A-2) and (A-3) are each an alkane compound in which two decahydronaphthalene rings are bonded to one and the same carbon atom in the alkane or to two different carbon atoms of the alkane adjacent to each other, respectively. The compounds of the types (A-4) and (A-5), on the other hand, each have a decahydronaphthalene ring and a cyclohexane ring. In the compounds of the type (A-4) which are each an alkane compound, the decahydronaphthalene ring and the cyclohexane ring are bonded to one and the same carbon atom of the alkane while the compounds of the type (A-5) are each a cyclohexyl decahydronaphthalene compound in which the decahydronaphthalene ring and the cyclohexane ring are bonded directly to each other. The decahydronaphthalene ring in the above mentioned types of the compounds may have one or more of substituent groups such as methyl groups.

The bis(decahydronaphthalene) compound as the type (A-1) is represented by the general formula

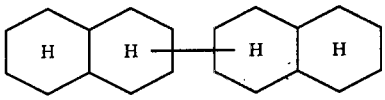

[I]

and include several isomeric compounds such as 1,1'-bis(decahydronaphthalene), 1,2'-bis(decahydronaphthalene) and 2,2'-bis(decahydronaphthalene). The decahydronaphthalene rings in these isomers may have one or more of substituent groups such as methyl, ethyl and propyl groups.

The compound of the type (A-2) is a bis(decahydronaphthyl)-substituted alkane compound represented by the general formula

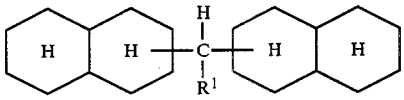

[II]

in which $R^1$ is a hydrogen atom or an alkyl group having 1 to 3 carbon atoms. Particular compounds belonging to the type (A-2) are: 1,1-di(decahydronaphthyl)ethanes of the general formula

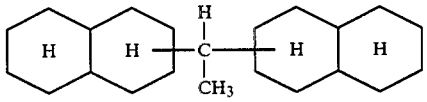

including 1,1-di(1-decahydronaphthyl)ethane, 1,1-di(2-decahydronaphthyl)ethane and 1-(1-decahydronaphthyl)-1-(2-decahydronaphthyl)ethane; 1,1-di(decahydronaphthyl)propanes of the general formula

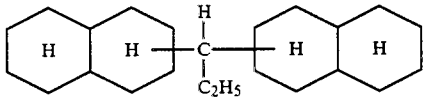

including 1,1-di(1-decahydronaphthyl)propane, 1,1-di(2-decahydronaphthyl)propane and 1-(1-decahydronaphthyl)-1-(2-decahydronaphthyl)propane; and 1,1-di(decahydronaphthyl)butanes of the general formula

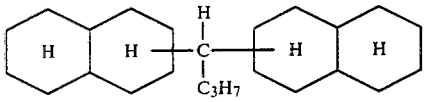

including 1,1-di(1-decahydronaphthyl)butane, 1,1-di(2-decahydronaphthyl)butane and 1-(1-decahydronaphthyl)-1-(2-decahydronaphthyl)butane.

The compound of the type (A-3) is an alkane compound having two decahydronaphthyl groups bonded to two adjacent carbon atoms in the structure of alkane and represented by the general formula

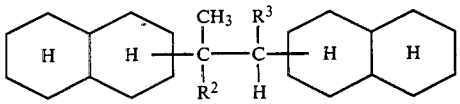

[III]

in which $R^2$ and $R^3$ are each a hydrogen atom or a methyl group. Particular examples of the compounds belonging to the type (A-3) are: 1,2-di(decahydronaphthyl)propanes of the general formula

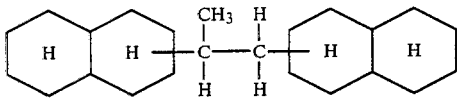

including 1,2-di(1-decahydronaphthyl)propane, 1,2,-di(2-decahydronaphthyl)propane, 1-(2-decahydronaphthyl)-2-(1-decahydronaphthyl)propane and 1-(1-decahydronaphthyl)-2-(2-decahydronaphthyl)propane; 2,3-di(decahydronaphthyl)butanes of the general formula

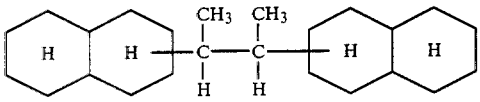

including 2,3-di(1-decahydronaphthyl)butane, 2,3-di(2-decahydronaphthyl)butane; and 2-(1-decahydronaphthyl)-3-(2-decahydronaphthyl)butane; 2-methyl-1,2-di(-decahydronaphthyl)propanes of the general formula

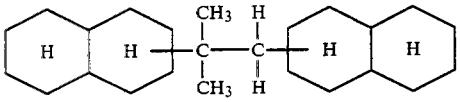

including 2-methyl-1,2-di(1-decahydronaphthyl)propane, 2-methyl-1,2-di(2-decahyrdonaphthyl)propane, 2-methyl-1-(1-decahydronaphthyl)-2-(2-decahydronaphthyl)propane and 2-methyl-1-(2-decahydronaphthyl)-2-(1-decahydronaphthyl)propane; and 2-methyl-2,3-di(decahydronaphthyl)butanes of the general formula

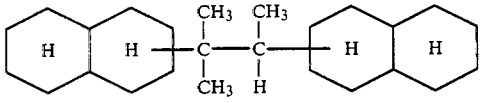

including 2-methyl-2,3-di(1-decahydronaphthyl)butane, 2-methyl-2,3-di(2-decahydronaphthyl)butane, 2-methyl-2-(1-decahydronaphthyl)-3-(2-decahydronaphthyl)-butane and 2-methyl-2-(2-decahydronaphthyl)-3-(1-decahydronaphthyl)butane.

The compound of the type (A-4) is an alkane compound having a decahydronaphthyl group and a cyclohexyl group bonded to one and the same carbon atoms of the alkane structure and represented by the general formula

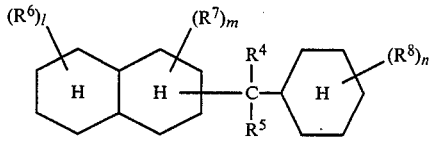

[IV]

in which each of the group denoted by the symbols $R^4$, $R^5$, $R^6$ and $R^7$ is a hydrogen atom or a methyl group, $R^8$ is a hydrogen atom or an alkyl group having 1 to 4 carbon atoms and the subscripts l, m and n are each a positive integer of 1, 2 or 3. Particular examples of the compounds belonging to the type (A-4) are:

1-(2-decahydronaphthyl)-1-cyclohexyl ethane of the formula

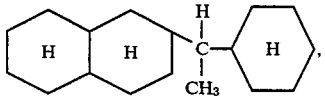

1-(1-decahydronaphthyl)-1-cyclohexyl ethane of the formula

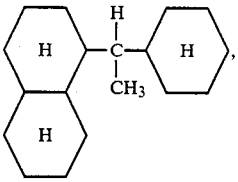

1-(2-methyldecahydronaphthyl)-1-cyclohexyl ethane expressed by the formula

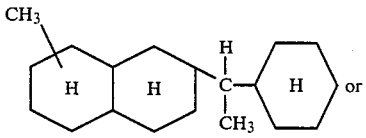

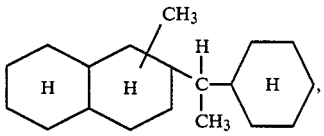

or 1-(1-methyldecahydronaphthyl)-1-cyclohexyl ethane expressed by the formula

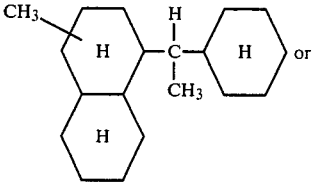

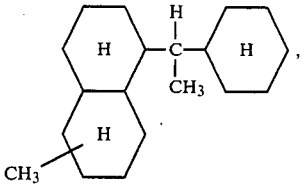

or 1-dimethyldecahydronaphthyl-1-cyclohexyl ethane expressed by either one of the formulas

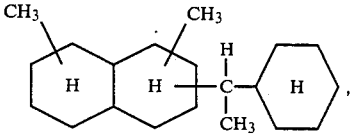

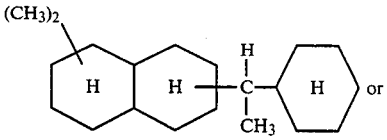

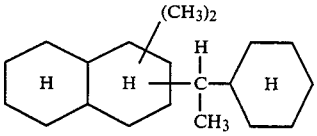

and 1-(2-decahydronaphthyl)-1-(4-tert-butylcyclohexyl)ethane of the formula

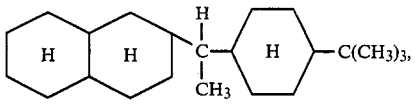

1-(1-decahydronaphthyl)-1-(4-tert-butylcyclohexyl)ethane of the formula

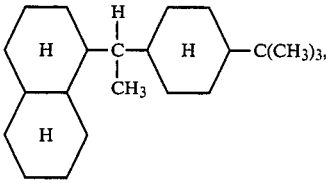

2-(2-decahydronaphthyl)-2-cyclohexyl propane of the formula

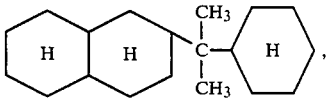

and 2-(1-decahydronaphthyl)-2-cyclohexyl propane of the formula

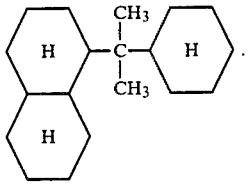

The compound of the type (A-5) is a cyclohexyl decahydronaphthalene compound represented by the general formula

[V]

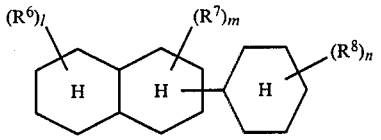

in which $R^6$, $R^7$ and $R^8$ and l, m and n each have the same meaning as defined above. A particularly suitable compound belonging to this type is 1-cyclohexyl-1,4-dimethyl decahydronaphthalene of the formula

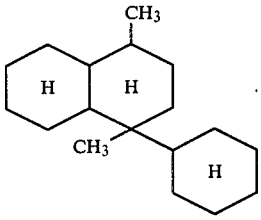

The component (B) as the other essential ingredient in the inventive working fluid for traction drive besides the above described component (A) includes the compounds of the types (B-1) and (B-2) defined above. Each of these compounds have two cyclohexane rings in a molecule. The compound of the type (B-1) is a dicyclohexyl-substituted alkane compound, of which the main chain of the alkane structure has two or three carbon atoms having at least two methyl groups bonded thereto and the two cyclohexyl groups are bonded to the carbon atoms at the chain terminals of the alkane structure. The compound of the type (B-2) is a dicyclohexyl-substituted cyclopentane compound. It is optional that the cyclohexane ring in the compounds of the types (B-1) and (B-2) may have one or more of methyl groups as the substituent groups.

The dicyclohexyl alkane compound of the type (B-1) is represented by the general formula

[VI]

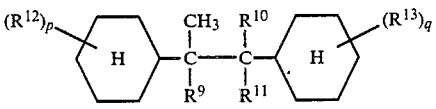

in which the groups denoted by the symbols $R^9$, $R^{10}$, $R^{11}$, $R^{12}$ and $R^{13}$ are each a hydrogen atom or a methyl group and the subscripts p and q are each a positive integer of 1, 2 or 3, at least one of the groups denoted by $R^9$, $R^{10}$ and $R^{11}$ being a methyl group, or by the general formula

[VII]

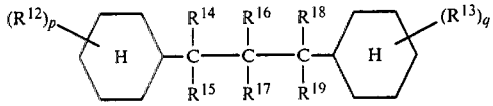

in which $R^{12}$, $R^{13}$, p and q each have the same meaning as defined above and $R^{14}$, $R^{15}$, $R^{16}$, $R^{17}$, $R^{18}$ and $R^{19}$ are each a hydrogen atom or a methyl group, at least two of the groups denoted by $R^{14}$ to $R^{19}$ being methyl groups.

Particular examples of the compound represented by the general formula [VI] include 1,2-di(methylcyclohexyl)-2-methyl propanes of the formula

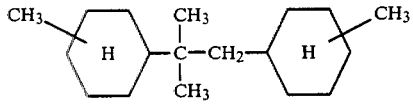

and 2,3-di(methylcyclohexyl) butanes of the formula

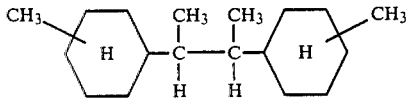

and particular examples of the compound represented by the general formula [VIII] include 1,3-dicyclohexyl-3-methyl butane of the formula

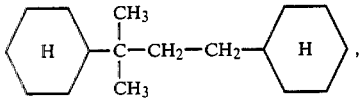

2,4-dicyclohexyl pentane of the formula

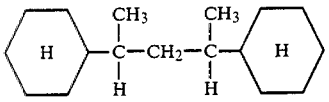

and 2,4-dicyclohexyl-2-methyl pentane of the formula

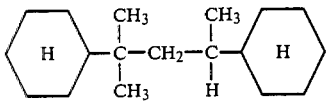

The dicyclohexyl cyclopentane compound of the type (B-2) is represented by the general formula

[VIII]

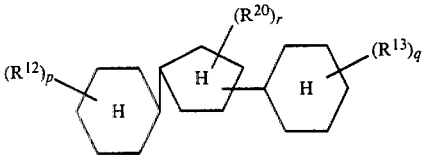

in which $R^{12}$, $R^{13}$, p and q each have the same meaning as defined above, $R^{20}$ is a hydrogen atom or a methyl group and r is a positive integer of 1, 2 or 3. A particularly preferable compound of the type (B-2) is 1,3-dicyclohexyl-1-methyl cyclopentane of the formula

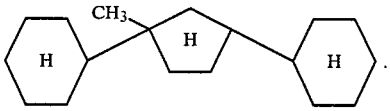

The working fluid for traction drive use of the invention comprises, as the principal ingredients thereof, the component (A), i.e. one or a combination of the compounds belonging to the types (A-1) to (A-5), and the component (B), i.e. one or a combination of the compounds belonging to the types (B-1) and (B-2), and has a kinematic viscosity of at least 3 centistokes at 100° C.

The compound as the above described component (A) has a high traction coefficient at high temperatures while the relatively high viscosity thereof causes a large agitation loss and is not without a problem in respect of the flowability at low temperatures. The compound as the component (B), on the other hand, has an advantageously low viscosity but has problems that the traction coefficient thereof is unduly decreased at high temperatures and the too low viscosity sometimes causes discontinuity in the oil films. In the working fluid for traction drive according to the invention, which is prepared by mixing the components (A) and (B) in such a proportion that the fluid has a kinematic viscosity of at least 3 centistokes at 100° C., on the contrary, a sufficiently high traction coefficient can be obtained over a wide temperature range from a low temperature to a high temperature despite the relatively low viscosity of the fluid and the fluid has excellent overall performance without the problems of the flowability at low temperatures and discontinuity of oil films at high temperatures. The great improvement in the traction coefficient of the working fluid for traction drive of the present invention is a result of the unexpectedly obtained synergistic effect of the components (A) and (B) mixed together.

It is generally known according to the teaching in ASLE Transactions, volume 13, pages 105–116 (1969) that an additivity rule is held between the traction coefficient of a mixture and the traction coefficients of the components of the mixture according to the equation $$f = \sum_i C_i f_i,$$

in which $C_i$ is the weight fraction of the i-th component in the mixture, $f_i$ is the traction coefficient of the i-th component and f is the traction coefficient of the mixture. Although it is also taught in SAE 710837 (1971) that a slight synergistic effect of about 2 to 3% can be obtained in some cases, no disclosure is found at all that the traction coefficient of a mixture is larger than the value of any of the components or the traction coefficient of a mixture is larger by 10% or more than the weighted average of the values of the components.

The mixing ratio of the components (A) and (B) in the inventive working fluid for traction drive is not particularly limitative provided that the resultant mixture has a kinematic viscosity of at least 3 centistokes or, preferably, in the range from 3.6 to 10.0 centistokes at 100° C. Although no definite mixing ratio by weight of the components can be given since the viscosity of a mixture naturally depends on the types of the compounds used as the components (A) and (B), it is usual that 100 parts by weight of the component (A) is admixed with the component (B) in an amount in the range from 10 to 900 parts by weight or, preferably, from 15 to 600 parts by weight. It should be noted here that a mixture having a kinematic viscosity of lower than 3 centistokes at 100° C., even when it is mainly composed of the components (A) and (B), cannot exhibit full performance for traction drive use so that a traction drive apparatus using such a fluid cannot have a serviceable life reaching the rated value due to the rolling fatigue and the apparatus cannot be driven continuously for a long period of time.

It is known that the rolling-element fatigue life is a function of the surface roughness of the rolling contact surfaces and the thickness of the oil film formed thereon and this relationship is called an oil film parameter. According to the disclosure in Machine Design, volume 7, page 102 (1974) in connection with the relationship between the oil film parameter and the surface fatigue, a life longer than the estimated value can be obtained when it is larger than 0.9.

According to the results of a calculation carried out by applying the above described facts to an actual bearing as an example of the rolling contact surfaces assuming a working temperature of 100° C., a rolling contact factigue life of at least the rated value or design value can be obtained when the working fluid for traction drive has a viscosity of at least 3.0 centistokes or, preferably, at least 3.6 centistokes at the temperature. In other words, the fluid should be formulated in such a weight proportion of the components that the fluid may have a viscosity of at least 3.0 centistokes or, preferably, at least 3.6 centistokes at 100° C. It is also desirable for a fluid used in automobiles that the pour point thereof is −30° C. or lower in order to ensure smooth starting at low temperatures.

It is of course that the working fluid for traction drive of the invention may contain various kinds of additives known in the art in addition to the above described components (A) and (B) as the principal ingredients.

As is understood from the above given description, the working fluid for traction drive of the present invention has excellent overall performance, in particular, with a high and stable traction coefficient over a wide temperature range from low to high temperatures so that the fluid is useful in a variety of machines including continuously variable transmissions for automobiles and industrial machines, hydraulic machines and the like.

In the following, the working fluid for traction drive of the invention is described in more detail by way of examples preceded by the description of the synthetic preparation of the compounds used as the components (A) and (B).

In the following Examples and Comparative Examples, the traction coefficient of the fluid was determined according to the procedure described below using a two roller machine. Each of the rollers had a diameter of 52 mm and a thickness of 6 mm and one of them for driving had a flat form without crowning while the other driven by the driving roller had a barrel-shaped form with a crown radius of 10 mm. One of the rollers was rotated at a constant velocity of 1500 rpm while the other was continuously rotated at a velocity of 1500 to 1750 rpm under a contacting pressure of 7 kg by means of a spring to determine the tangential force, i.e. traction force, generated between the rollers from which the traction coefficient was calculated. The rollers were made of a steel for rolling bearing SUJ-2 and the surface was polished as smooth as a mirror. The maximum Hertzian contact pressure thereof was 112 kgf/mm$^2$.

The determination of the relation between the traction coefficient and the oil temperature was performed by controlling the oil temperature in the range from 30° C. to 120° C. with the oil reservoir heated with a heater and the results were shown in a graph by plotting the relation between the traction coefficient at a slip ratio of 5% and the oil temperature.

The determination of the relation between the traction coefficient and the mixing ratio of the components (A) and (B) was performed by keeping the fluid at a constant temperature.

PREPARATION 1

Into a glass flask of 5 liters capacity were introduced 2500 g of tetrahydronaphthalene and 500 g of concentrated sulfuric acid and the mixture was chilled at 0° C. by dipping the flask in an ice water bath. Then, 150 g of paraldehyde were added to the mixture in the flask under vigorous agitation dropwise over a period of 3 hours followed by further continued agitation for additional 1 hour to complete the reaction. After standing for a while without agitation, the reaction mixture was subjected to phase separation to take the oily phase, which was washed 3 times each with 1 liter of a 2N aqueous solution of sodium hydroxide and further 3 times each with 1 liter of a saturated aqueous solution of sodium chloride followed by drying over anhydrous sodium sulfate. The oily material was then distilled to remove the unreacted tetrahydronaphthalene and further subjected to distillation under reduced pressure to give 800 g of a fraction boiling at 150° to 185° C. under a pressure of 0.15 mmHg. Analysis of this fraction indicated that the principal ingredient thereof was 1,1-di(-tetrahydronaphthyl) ethane accompanied by a minor amount of a dimer of tetrahydronaphthalene.

A 500 ml portion of the above obtained fraction was introduced into an autoclave of 1 liter capacity with addition of 50 g of a nickel catalyst for hydrogenation (N-113, a product by Nikki Kagaku Co.) and the hydrogenation reaction was performed at a temperature of 200° C. under a hydrogen pressure of 50 kg/cm$^2$ for 5 hours. After cooling, the reaction mixture was filtered to remove the catalyst and the filtrate was stripped to remove the light fraction. The results obtained in the NMR analysis of the product indicated that at least 99.9% of the starting material had been hydrogenated. This product contained 65% by weight of 1,1-di(-decahydronaphthyl) ethane and 25% by weight of 1,1'- and 1,2'-bis(decahydronaphthalenes).

PREPARATION 2

Into a flask of 3 liters capacity were introduced 1564 g of toluene and 40 g of anhydrous aluminum chloride. A mixture of 272 g of methallyl chloride and 92 g of toluene was added dropwise into the mixture in the flask at room temperature under agitation over a period of 5 hours followed by further continued agitation for additional 1 hour to complete the reaction. After addition of 500 ml of water to the reaction mixture to decompose the aluminum chloride, the mixture was subjected to phase separation to take the oily phase, which was washed first 3 times each with 1 liter of a 1N aqueous solution of sodium hydroxide and then 3 times each with 1 liter of a saturated aqueous solution of sodium chloride followed by drying over anhydrous sodium sulfate. The oily material was distilled to remove the unreacted toluene and then subjected to distillation under reduced pressure to give 500 g of a fraction boiling in a temperature range of 106° to 113° C. under a pressure of 0.16 mmHg. The principal ingredient of this fraction was 2-methyl-1,2-di(4-tolyl) propane.

A 500 g portion of the above obtained fraction was introduced into an autoclave of 1 liter capacity with addition of 50 g of a nickel catalyst for hydrogenation (N-113, a product by Nikki Kagaku Co.) and the hydrogenation reaction was performed at 200° C. for 3 hours under a hydrogen pressure of 50 kg/cm$^2$G. After stripping of light fraction, the reaction product was analyzed to find that 99.9% or more of the starting material had been hydrogenated and the principal ingredient thereof was 2-methyl-1,2-di(4-methylcyclohexyl) propane.

EXAMPLE 1

Figure 2:
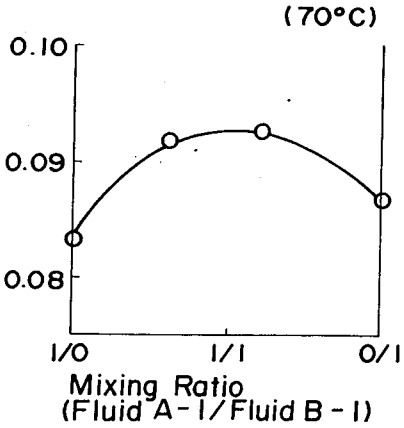
FIGS. 2, 4, 6 and 8 are each a graphic showing of the traction coefficient of the fluid prepared by mixing two kinds of the compounds obtained in the Preparations as a function of the mixing ratio.

The reaction product obtained in Preparation 1, referred to as the Fluid A-1 hereinbelow, containing 1,1-di(decahydronaphthyl) ethane and 1,1'- and 1,2'-bis(-decahydronaphthalenes) and the reaction product obtained in Preparation 2, referred to as the Fluid B-1 hereinbelow, were blended in a weight ratio (Fluid A-1):(Fluid B-1) of 2:3 to give a mixed fluid referred to as the Mixed Fluid 1 hereinbelow. Several properties of this Mixed Fluid 1 are shown in Table 1 below. FIG. 1 of the accompanying drawing shows the traction coefficient of the Mixed Fluid 1 as a function of temperature. FIG. 2 shows the traction coefficient of mixtures of the Fluids A-1 and B-1 in varied proportions at 70° C. as a function of the mixing ratio.

COMPARATIVE EXAMPLE 1

Table 1 also shows the properties of the Fluid A-1 prepared in Preparation 1 and FIG. 1 shows the traction coefficient thereof as a function of temperature.

COMPARATIVE EXAMPLE 2

Table 1 also shows the properties of the Fluid B-1 prepared in Preparation 2 and FIG. 1 shows the traction coefficient thereof as a function of temperature.

TABLE 1

| | Fluid | Kinematic viscosity, cSt at 40° C. | Kinematic viscosity, cSt at 100° C. | Viscosity index | Pour point, °C. |
|---|---|---|---|---|---|
| Example 1 | Mixed Fluid 1 | 40.15 | 4.552 | −87 | −30.0 |
| Comparative Example 1 | Fluid A-1 | 606.3 | 13.44 | −307 | +2.5 |
| Comparative Example 2 | Fluid B-1 | 13.09 | 2.640 | −22 | below −35 |

PREPARATION 3

Into a glass flask of 3 liters capacity were introduced 1000 g of α-methylstyrene, 50 g of acid clay and 50 g of ethylene glycol and the mixture was heated at 140° C. for 2 hours under agitation. After filtration to remove the acid clay as the catalyst, the reaction mixture was distilled to remove the unreacted α-methylstyrene and ethylene glycol and then subjected to distillation under reduced pressure to give 900 g of a fraction boiling at 125° to 130° C. under a pressure of 0.2 mmHg. The results of the NMR and gas chromatographic analyses indicated that this fraction was a mixture of 95% of a linear dimer and 5% of a cyclic dimer of α-methylstyrene.

The thus obtained mixture of dimers of α-methylstyrene was subjected to the hydrogenation reaction in the same manner as in Preparation 2 followed by post-treatment to give a fluid mostly composed of 2,4-dicyclohexyl-2-methyl pentane, which was suitable for traction drive use.

EXAMPLE 2

Figure 4:
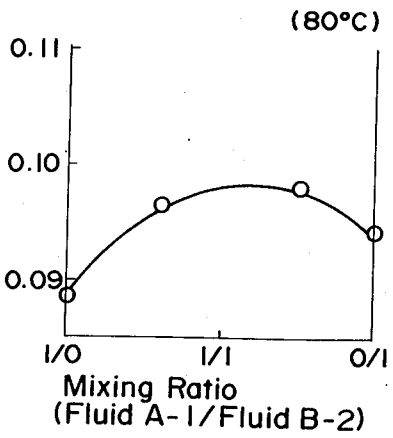
Figure 3:
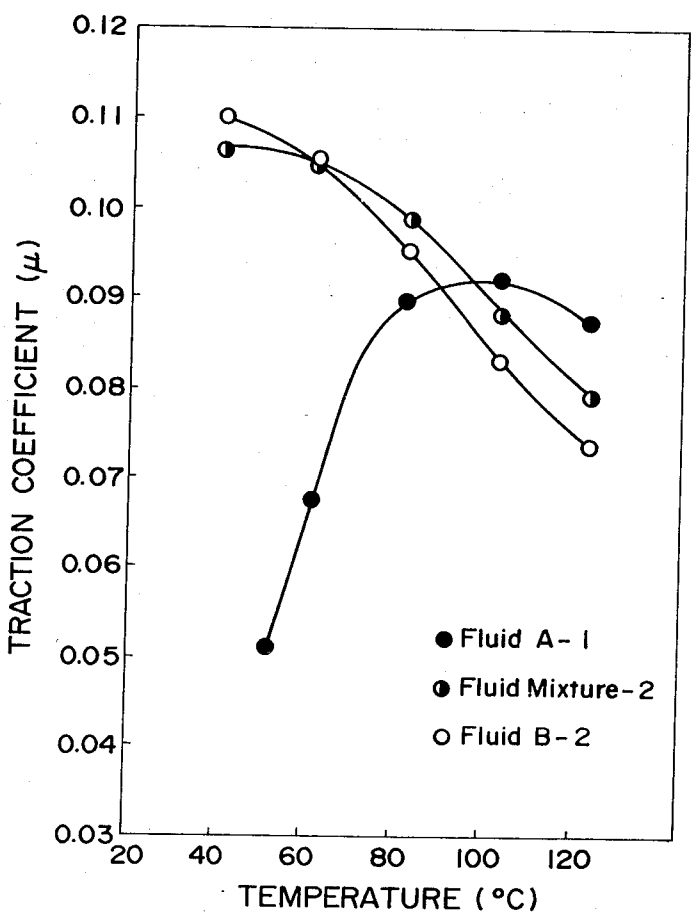

The Fluid A-1 obtained in Preparation 1 and the fluid obtained in Preparation 3 and mostly composed of 2,4-dicyclohexyl-2-methyl pentane, referred to as the Fluid B-2 hereinbelow, were mixed together in a mixing ratio by weight (Fluid A-1):(Fluid B-2) of 1:3 to give a mixed fluid, which is referred to as the Mixed Fluid 2 hereinbelow. Several properties of this Mixed Fluid 2 are shown in Table 2 below. FIG. 3 shows the traction coefficient of the Mixed Fluid 2 as a function of temperature. Further, FIG. 4 shows the traction coefficient of mixture of the Fluids A-1 and B-2 in varied proportions at 80° C. as a function of the mixing ratio.

COMPARATIVE EXAMPLE 3

Table 2 also shows the properties of the Fluid B-2 obtained in Preparation 3 and FIG. 3 shows the traction coefficient thereof as a function of temperature. Table 2 and FIG. 3 include the properties of the Fluid A-1 to facilitate comparison.

TABLE 2

| | Fluid | Kinematic Viscosity, cSt at 40° C. | Kinematic Viscosity, cSt at 100° C. | Viscosity index | Pour point, °C. |
|---|---|---|---|---|---|
| Example 2 | Mixed Fluid 2 | 36.82 | 4.726 | −13 | −30.0 |
| Comparative Example 1 | Fluid A-1 | 606.3 | 13.44 | −307 | +2.5 |
| Comparative Example 3 | Fluid B-2 | 20.27 | 3.580 | 13 | below −35 |

PREPARATION 4

Into a flask of 5 liters capacity were introduced 3960 g of tetrahydronaphthalene and 120 g of anhydrous iron (III) chloride to form a mixture, into which 634 g of methallyl chloride were added dropwise over a period of 8 hours at room temperature under agitation followed by further continued agitation for additional 1 hour to complete the reaction. Thereafter, the reaction mixture was admixed with 1 liter of water and subjected to phase separation to take the oily phase, which was washed first 3 times each with 1 liter of a 1N aqueous solution of sodium hydroxide and then 3 times each with 1 liter of a saturated aqueous solution of sodium chloride followed by drying over anhydrous sodium sulfate. The thus obtained oily material was distilled to remove the unreacted tetrahydronaphthalene and then subjected to distillation under reduced pressure to give 500 g of a fraction boiling in a temperature range of 165° to 195° C. under a pressure of 0.12 mmHg. This fraction was composed mainly of 2-methyl-1,2-di(tetrahydronaphthyl) propane.

The thus obtained product was introduced into an autoclave of 1 liter capacity together with 50 g of an activated 0.5% plutinum-alumina catalyst (a product by Nippon Engelhard Co.) and the hydrogenation reaction was performed by heating the mixture in the autoclave at 200° C. for 4 hours under a hydrogen pressure of 50 kg/cm$^2$G. After completion of the reaction, the reaction mixture was stripped to remove the light fraction and analyzed to find that the product contained 80% by weight of 2-methyl-1,2-di(decahydronaphthyl) propane and 10% by weight of 1,1'- and 1,2'-bis(decahydronaphthalenes).

PREPARATION 5

Into a four-necked glass flask of 1 liter capacity equipped with a stirrer, dropping funnel, reflux condenser with a drier tube of calcium chloride and bifurcated tube for thermometer and gas inlet were introduced 200 ml of decahydronaphthalene, 9.2 g (0.40 mole) of metallic sodium and 11.2 g (0.20 mole) of potassium hydroxide to form a reaction mixture. Argon gas was passed into the flask from the gas inlet for 10 minutes at a rate of 100 ml per minute and then at a decreased rate of 10 ml per minute while the mixture in the flask was continuously agitated. Thereafter, the flask was heated on an oil bath and 473 g (4.0 moles) of α-methylstyrene were added dropwise into the mixture in the flask kept at 135° C. over a period of 1 hour followed by further continued agitation for additional 30 minutes. After cooling of the reaction mixture to room temperature, 100 ml of methyl alcohol were added dropwise into the mixture under agitation to decompose the unreacted metallic sodium. Introduction of argon gas was discontinued and the reaction mixture was washed 3 times each with 200 ml of water followed by drying over anhydrous sodium sulfate. The thus obtained oily material was distilled under reduced pressure to give a fraction boiling at 139° to 141° C. under a pressure of 0.2 mmHg, which contained 250.7 g (2.12 moles) of 1-methyl-1,3-diphenyl cyclopentane as the principal ingredient.

In the next place, a 200 g (0.85 mole) portion of the thus obtained 1-methyl-1,3-diphenyl cyclopentane was introduced into a stainless steel-made autoclave of 1 liter capacity equipped with an electromagnetic stirrer together with 10 g of the same nickel catalyst as used in Preparation 2 and the hydrogenation reaction was performed by heating the mixture in the autoclave at 150° C. for 2 hours under a hydrogen pressure of 20 atmospheres. After completion of the reaction, the reaction mixture was filtered to remove the catalyst which was washed with xylene and the washing was combined with the filtrate. The mixture was freed of xylene using a rotary evaporator to give a product containing 206 g of 1,3-dicyclohexyl-1-methyl cyclopentane as the principal ingredient.

EXAMPLE 3

Figure 6:
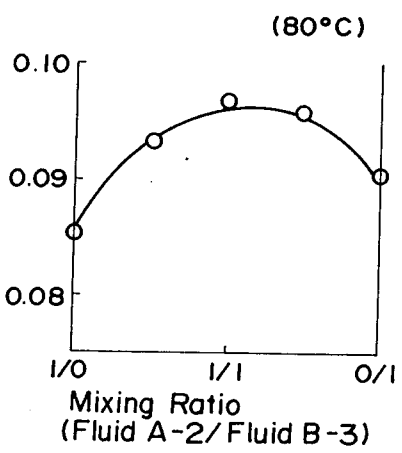
Figure 5:
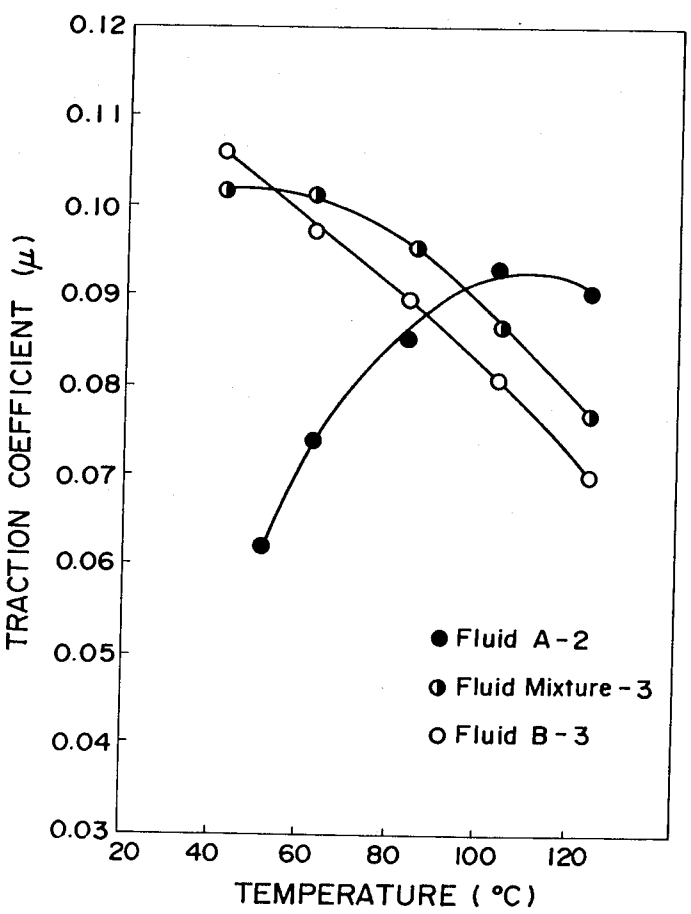

Table 3 below shows the properties of a mixed fluid, which is referred to as the Mixed Fluid 3 hereinbelow, prepared by blending the product of Preparation 4 containing 80% by weight of 2-methyl-1,2-di(decahydronaphthyl) propane and 10% by weight of 1,1'- and 1,2'-bis(decahydronaphthalenes), referred to as the Fluid A-2 hereinbelow, and the product of Preparation 5 containing 1,3-dicyclohexyl-1-methyl cyclopentane as the principal ingredient, referred to as the Fluid B-3 hereinbelow, in a mixing ratio (Fluid A-2):(Fluid B-3) of 1:3 by weight. FIG. 5 shows the traction coefficient of this mixed Fluid 3 as a function of temperature. Further, FIG. 6 shows the traction coefficient of mixtures of the Fluids A-2 and B-3 in varied proportions at 80° C. as a function of the mixing ratio.

COMPARATIVE EXAMPLE 4

Table 3 also shows the properties of the Fluid A-2 obtained in Preparation 4 and FIG. 5 also shows the traction coefficient of the same as a function of temperature.

COMPARATIVE EXAMPLE 5

Table 3 also shows the properties of the Fluid B-3 obtained in Preparation 5 and FIG. 5 also shows the traction coefficient of the same as a function of temperature.

TABLE 3

| | Fluid | Kinematic Viscosity, cSt at 40° C. | Kinematic Viscosity, cSt at 100° C. | Viscosity index | Pour point, °C. |
|---|---|---|---|---|---|
| Example 3 | Mixed Fluid 3 | 41.82 | 4.932 | −25 | −30 |
| Comparative Example 4 | Fluid A-2 | 761.6 | 13.29 | −453 | +5 |
| Comparative Example 5 | Fluid B-3 | 21.15 | 3.798 | −38 | below −35 |

PREPARATION 6

The synthetic procedure in this case was substantially the same as in Preparation 4 except that 634 g of methallyl chloride were replaced with 383 g of allyl chloride to give 700 g of a fraction boiling in a temperature range of 160° to 180° C. under a pressure of 0.1 mmHg. A 500 g portion of this fraction was subjected to the hydrogenation reaction in the same manner as in Preparation 4 to give a hydrogenation product containing 82% by weight of 1,2-di(decahydronaphthyl) propane and 1,1'- and 1,2'-bis(decahydronaphthalens). This fluid had a refractive index $n_D^{20}$ of 1.5190, specific gravity of 0.97 (15/4° C.) and kinematic viscosity of 660.2 centistokes and 13.99 centistokes at 40° C. and 100° C., respectively.

PREPARATION 7

Into a glass flask of 5 liters capacity were introduced 2300 g of cumene, 40 g of metallic sodium and 11 g of isopropyl alcohol to form a reaction mixture and then 650 g of styrene were added dropwise into the mixture in the flask heated at 130° C. under vigorous agitation over a period of 3 hours followed by further continued agitation for additional 1 hour to complete the reaction. After cooling by standing with discontinued agitation, the oily material was taken out and admixed with 200 g of ethyl alcohol followed by washing first 3 times each with 2 liters of a 5N hydrochloric acid and then 3 times each with 2 liters of a saturated aqueous solution of sodium chloride and dehydration over anhydrous sodium sulfate. The oily material was freed of the unreacted cumene on a rotary evaporator and then subjected to distillation under reduced pressure to give a fraction boiling at 115° to 125° C. under a pressure of 0.13 mmHg. Analysis of this fraction indicated that the principal ingredient thereof was 1,3-diphenyl-3-methyl butane which is an equimolar addition product of cumene and styrene.

A 500 ml portion of the above obtained reaction product was introduced into an autoclave of 1 liter capacity together with 50 g of the same nickel catalyst as used in Preparation 1 and the hydrogenation reaction was performed at 200° C. for 3 hours under a hydrogen pressure of 50 kg/cm$^2$. After cooling, the reaction mixture was filtered to remove the catalyst and analyzed by NMR to find that at least 99.9% of the starting material had been hydrogenated. Analysis of the product after stripping of the light fraction indicated that the principal ingredient thereof was 1,3-dicyclohexyl-3-methyl butane.

EXAMPLE 4

Figure 7:
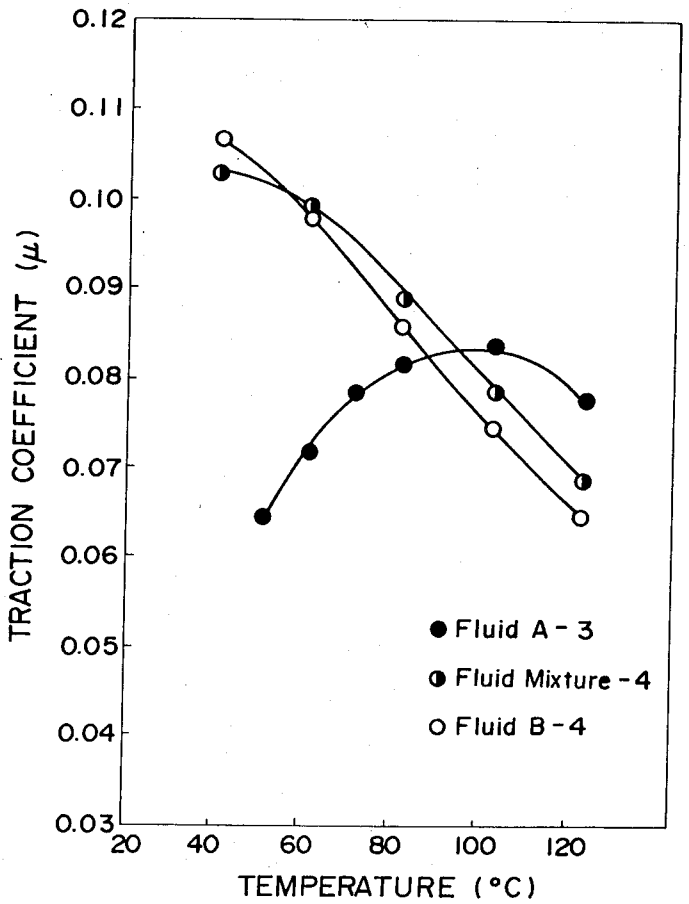
Figure 8:
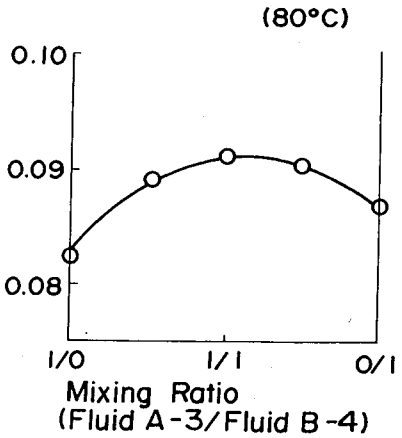

A mixed fluid, which is referred to as the Mixed Fluid 4 hereinbelow, was prepared by mixing the fluid obtained in Preparation 6, referred to as the Fluid A-3 hereinbelow, and the fluid obtained in Preparation 7, referred to as the Fluid B-4 hereinbelow, in a mixing ratio (Fluid A-3):(Fluid B-4) of 1:3 by weight. The properties of this Mixed Fluid 4 are shown in Table 4 below. FIG. 7 shows the traction coefficient of this Mixed Fluid 4 as a function of temperature. Further, FIG. 8 shows the traction coefficient of mixtures of the Fluids A-3 and B-4 in varied proportions at 80° C. as a function of the mixing ratio.

COMPARATIVE EXAMPLE 6

Table 4 also shows the properties of the Fluid A-3 obtained in Preparation 6 and FIG. 7 also shows the traction coefficient of the same as a function of temperature.

COMPARATIVE EXAMPLE 7

Table 4 also shows the properties of the Fluid B-4 obtained in Preparation 7 and FIG. 7 also shows the traction coefficient of the same as a function of temperature.

TABLE 4

| | Fluid | Kinematic Viscosity, cSt at 40° C. | Kinematic Viscosity, cSt at 100° C. | Viscosity index | Pour point, °C. |
|---|---|---|---|---|---|
| Example 4 | Mixed Fluid 4 | 33.73 | 4.397 | −43 | −35 |
| Comparative Example 6 | Fluid A-3 | 660.2 | 13.99 | −311 | +5 |
| Comparative | Fluid B-4 | 16.37 | 3.208 | 23 | below −35 |

TABLE 4-continued

| | Fluid | Kinematic Viscosity, cSt at 40° C. | Kinematic Viscosity, cSt at 100° C. | Viscosity index | Pour point, °C. |
|---|---|---|---|---|---|
| Example 7 | | | | | |

PREPARATION 8

Into a glass flask of 5 liters capacity were introduced 1000 g of naphthalene, 3000 ml of carbon tetrachloride and 300 g of concentrated sulfuric acid to form a reaction mixture, which was chilled at 0° C. by dipping the flask in an ice water bath. Then, 400 g of styrene were added dropwise into the mixture in the flask under agitation over a period of 3 hours followed by further continued agitation for additional 1 hour to complete the reaction. After completion of the reaction, the reaction mixture was kept standing with discontinued agitation and the oily material was taken by phase separation. The oily material was washed first 3 times each with 500 ml of a 1N aqueous solution of sodium hydroxide and then 3 times each with 500 ml of a saturated aqueous solution of sodium chloride followed by drying over anhydrous sodium sulfate. Thereafter, the oily material was distilled to remove the unreacted naphthalene and further subjected to distillation under reduced pressure to give 600 g of a fraction boiling at 135° to 148° C. under a pressure of 0.17 mmHg, which was identified by analysis to be a mixture of 75% by weight of 1-(1-naphthyl)-1-phenyl ethane and 25% by weight of 1-(2-naphthyl)-1-phenyl ethane.

In the next place, a 500 ml portion of the above obtained fraction was introduced into an autoclave of 1 liter capacity together with 20 g of 5% ruthenium-carbon catalyst (a product by Nippon Engelhard Co.) and the hydrogenation reaction was performed at 200° C. for 4 hours under a hydrogen pressure of 50 kg/cm$^2$. After completion of the reaction, the reaction mixture was filtered to remove the catalyst and the filtrate was freed of the light fraction by stripping. Analysis of the thus obtained product indicated that more than 99.9% of the starting material had been hydrogenated and the product was a mixture of 75% by weight of 1-(1-decahydronaphthyl)-1-cyclohexyl ethane and 25% by weight of 1-(2-decahydronaphthyl)-1-cyclohexyl ethane.

PREPARATION 9

Into a glass flask of 5 liters capacity were introduced 2700 g of ethyl benzene, 58 g of metallic sodium and 17 g of isopropyl alcohol to form a reaction mixture and then a mixture of 1100 g of α-methyl styrene and 300 g of ethyl benzene was added dropwise into the mixture in the flask heated at 120° C. under agitation gradually over a period of 5 hours followed by further continued agitation for additional 1 hour to complete the reaction. After completion of the reaction, the reaction mixture was cooled and the oily material taken therefrom was admixed with 200 g of methyl alcohol followed by washing first 3 times each with 2 liters of 5N hydrochloric acid and then 3 times each with 2 liters of a saturated aqueous solution of sodium chloride and drying over anhydrous sodium sulfate. The oily material was then freed of the unreacted ethyl benzene and further distilled under reduced pressure to give 1500 g of a fraction boiling at 104° to 110° C. under a pressure of 0.06 mmHg, which was identified by analysis to be 2,4-diphenyl pentane.

A 500 ml portion of the above obtained fraction was introduced into an autoclave of 1 liter capacity together with 20 g of the same nickel catalyst for hydrogenation as used in Preparation 2 and the hydrogenation reaction was performed at 200° C. for 3 hours under a hydrogen pressure of 50 kg/cm$^2$G. After completion of the reaction mixture was filtered to remove the catalyst and the filtrate was freed of the light fraction by stripping. The analysis of the thus obtained product indicated that more than 99.9% of the starting material had been hydrogenated and the product was identified to be 2,4-dicyclohexyl pentane.

EXAMPLE 5

Figure 10:
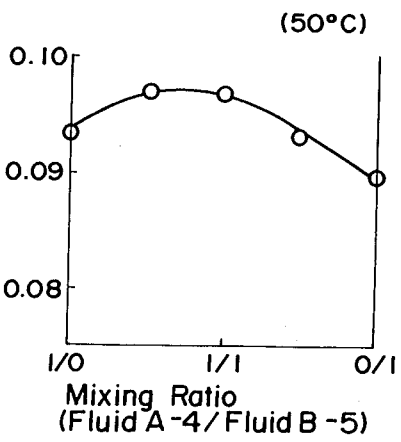
FIGS. 10, 12, 14, 16, 18, 20, 22, 24 and 26 are each a graphic showing of the traction coefficient of the fluid prepared by mixing two kinds of the compounds obtained in the Preparations as a function of the mixing ratio.
Figure 9:
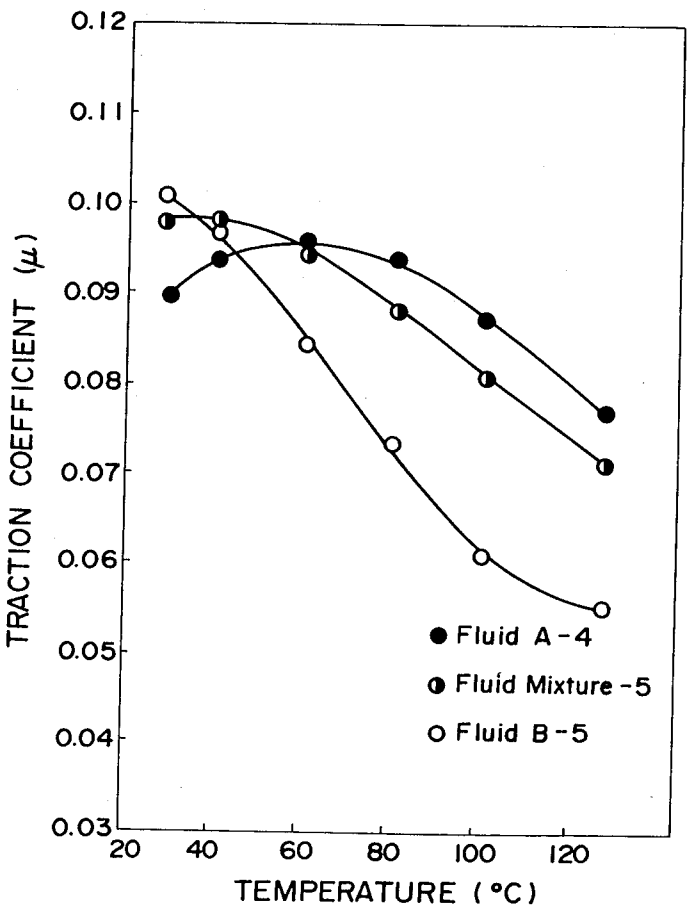
FIGS. 9, 11, 13, 15, 17, 19, 21, 23 and 25 are each a graphic showing of the traction coefficient vs. temperature relationship of the fluid prepared in one of the Examples and Comparative Examples.

A mixed fluid, which is referred to as the Mixed Fluid 5, was prepared by mixing the product of Preparation 8 composed of 75% by weight of 1-(1-decahydronaphthyl)-1-cyclohexyl ethane and 25% by weight of 1-(2-decahydronaphthyl)-1-cyclohexyl ethane, which is referred to as the Fluid A-4 hereinbelow, and 2,4-dicyclohexyl pentane obtained in Preparation 9, which is referred to as the Fluid B-5 hereinbelow, in a mixing ratio (Fluid A-4):(Fluid B-5) of 3:1 by weight. Several properties of this Mixed Fluid 5 are shown in Table 5 below. FIG. 9 of the accompanying drawing shows the traction coefficient of the Mixed Fluid 5 as a function of temperature. Further, FIG. 10 shows the traction coefficient of mixtures of the Fluids A-4 and B-5 in varied mixing ratios at 50° C. as a function of the mixing ratio.

COMPARATIVE EXAMPLE 8

Properties of the Fluid A-4 obtained in Preparation 8 are shown in Table 5 and the traction coefficient of the same is shown in FIG. 9 as a function of temperature.

COMPARATIVE EXAMPLE 9

Properties of the Fluid B-5 obtained in Preparation 9 are shown in Table 5 and the traction coefficient of the same is shown in FIG. 9 as a function of temperature.

TABLE 5

| | Fluid | Kinematic Viscosity, cSt at 40° C. | Kinematic Viscosity, cSt at 100° C. | Viscosity index | Pour point, °C. |
|---|---|---|---|---|---|
| Example 5 | Mixed Fluid 5 | 28.57 | 4.333 | 14 | −35 |
| Comparative Example 8 | Fluid A-4 | 42.60 | 4.884 | −41 | −20.0 |
| Comparative Example 9 | Fluid B-5 | 11.82 | 2.722 | 48 | below −35 |

PREPARATION 10

Substantially the same synthetic procedure as in Preparation 8 was undertaken except that naphthalene and carbon tetrachloride were replaced with 550 g of 4-(tert-butyl) styrene to give 800 g of a fraction boiling at 180° to 190° C. under a pressure of 0.9 mmHg. This fraction was identified by analysis to be mixture of 1-(1-tetrahydronaphthyl)-1-(4-tert-butyl phenyl) ethane and 1-(2-tetrahydronaphthyl)-1-(4-tert-butyl phenyl) ethane.

The above obtained fraction was subjected to the hydrogenation reaction in the same manner as in Preparation 8 followed by stripping of the light fraction to give a product, which could be identified to be a mixture of 1-(1-decahydronaphthyl)-1-(4-tert-butyl cyclohexyl) ethane and 1-(2-decahydronaphthyl)-1-(4-tert-butyl cyclohexyl) ethane.

EXAMPLE 6

Figure 12:
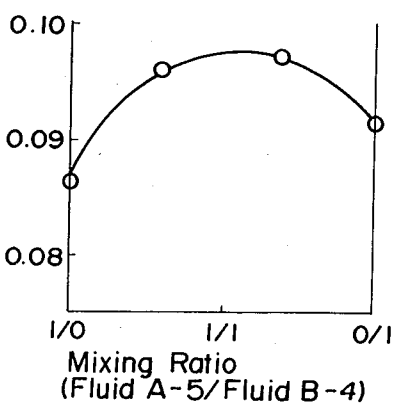
Figure 11:
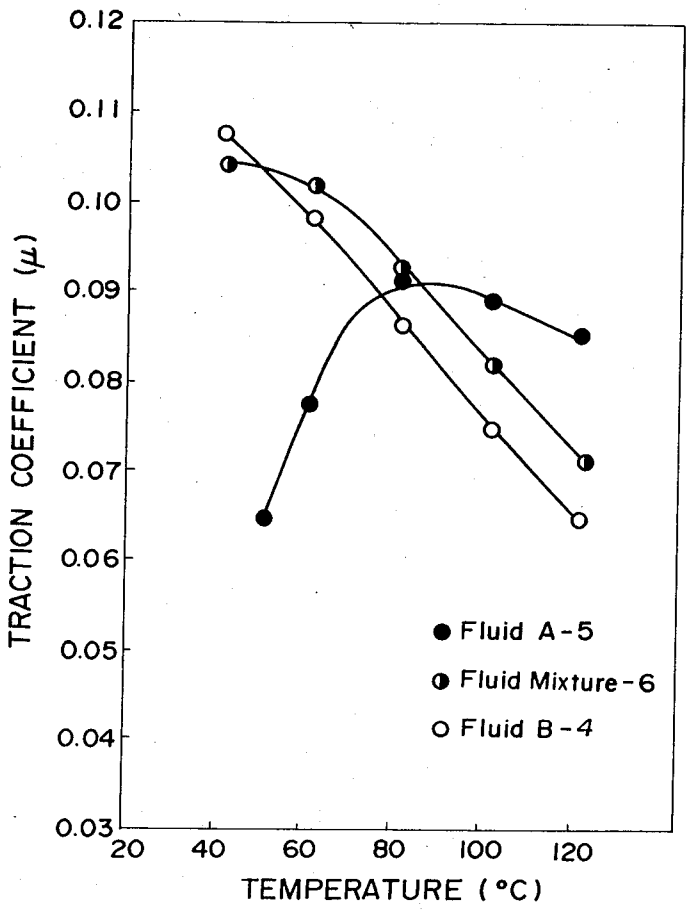

A mixed fluid, referred to as the Mixed Fluid 6 hereinbelow, was prepared by mixing the fluid obtained in Preparation 10, referred to as the Fluid A-5 hereinbelow, which was a mixture of 1-(1-decahydronaphthyl)-1-(4-tert-butyl cyclohexyl) ethane and 1-(2-decahydronaphthyl)-1-(4-tert-butyl cyclohexyl) ethane, and the fluid obtained in Preparation 7, referred to as the Fluid B-4 hereinbelow, which was 1,3-dicyclohexyl-3-methyl butane, in a mixing ratio (Fluid A-5):(Fluid B-4) of 3:7 by weight. Several properties of this Mixed Fluid 6 are shown in Table 6 below. Further, the traction coefficient of this Mixed Fluid 6 is shown in FIG. 11 as a function of temperature. FIG. 12 shows the traction coefficient of mixed fluids of the Fluids A-5 and B-4 in varied proportions at 70° C. as a function of the mixing ratio.

COMPARATIVE EXAMPLE 10

Properties of the Fluid A-5 obtained in Preparation 10 are shown in Table 6 and the traction coefficient of the same is shown in FIG. 11 as a function of temperature.

Table 6 and FIG. 11 include the data for the Fluid B-4 already given in Table 4 and FIG. 7, respectively, to facilitate comparison.

TABLE 6

| | Fluid | Kinematic Viscosity, cSt at 40° C. | Kinematic Viscosity, cSt at 100° C. | Viscosity index | Pour point, °C. |
|---|---|---|---|---|---|
| Example 6 | Mixed Fluid 6 | 29.67 | 4.288 | −10 | −32.5 |
| Comparative Example 10 | Fluid A-5 | 244.5 | 10.00 | −149 | −2.5 |
| Comparative Example 7 | Fluid B-4 | 16.47 | 3.208 | 23 | below −35 |

PREPARATION 11

The synthetic procedure of the addition reaction, distillation of the addition product, hydrogenation reaction and distillation of the hydrogenation product was substantially the same as in Preparation 8 except that naphthalene and carbon tetrachloride used in Preparation 8 were replaced with each 500 g of $\alpha$- and $\beta$-methyl naphthalenes. The product was a mixture of 1-(1-methyl decahydronaphthyl)-1-cyclohexyl ethane and 1-(2-methyl decahydronaphthyl)-1-cyclohexyl ethane.

EXAMPLE 7

Figure 13:
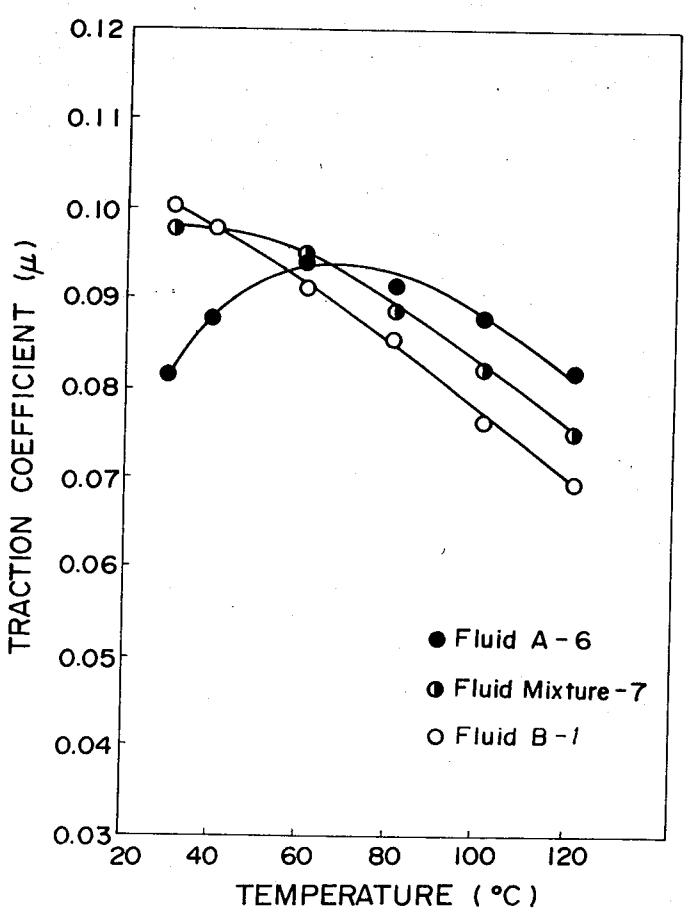
Figure 14:
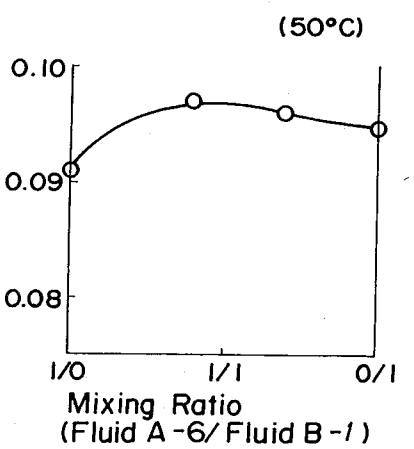

A mixed fluid, referred to as the Mixed Fluid 7 hereinbelow, was prepared by mixing the product obtained in Preparation 11 and composed of 1-(1-methyl decahydronaphthyl)-1-cyclohexyl ethane and 1-(2-methyl decahydronaphthyl)-1-cyclohexyl ethane, referred to as the Fluid A-6 hereinbelow, and the product of Preparation 2, i.e. 2-methyl-1,2-di(4-methyl cyclohexyl) propane, referred to as the Fluid B-1 hereinbelow, in a mixing ratio (Fluid A-6):(Fluid B-1) of 3:2 by weight. Several properties of this Mixed Fluid 7 are shown in Table 7 below. FIG. 13 of the accompanying drawing shows the traction coefficient of the Mixed Fluid 7 as a function of temperature. FIG. 14 shows the traction coefficient of mixtures of the Fluids A-6 and B-1 in varied proportions at 50° C. as a function of the mixing ratio.

COMPARATIVE EXAMPLE 11

Table 7 also shows the properties of the Fluid A-6 obtained in Preparation 11 and the traction coefficient of the same is shown in FIG. 13 as a function of temperature.

COMPARATIVE EXAMPLE 2

Table 7 also shows the properties of the Fluid B-1 obtained in Preparation 2 and the traction coefficient of the same is shown in FIG. 13 as a function of temperature.

TABLE 7

| | Fluid | Kinematic Viscosity, cSt at 40° C. | Kinematic Viscosity, cSt at 100° C. | Viscosity index | Pour point, °C. |
|---|---|---|---|---|---|
| Example 7 | Mixed Fluid 7 | 30.10 | 4.168 | −43 | −35 |
| Comparative Example 11 | Fluid A-6 | 72.14 | 5.810 | −96 | −15.0 |
| Comparative Example 2 | Fluid B-1 | 13.09 | 2.640 | −22 | below −35 |

PREPARATION 12

The synthetic procedure of the addition reaction, distillation of the addition product, hydrogenation reaction and distillation of the hydrogenation product was substantially the same as in Preparation 8 except that naphthalene and carbon tetrachloride used in Preparation 8 were replaced with 1000 g of an isomeric mixture of dimethyl naphthalenes to give a product which was a mixture of 1-(1-dimethyl decahydronaphthyl)-1-cyclohexyl ethane and 1-(2-dimethyl decahydronaphthyl)-1-cyclohexyl ethane.

EXAMPLE 8

Figure 16:
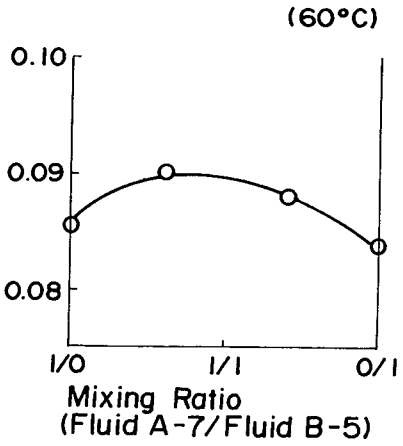
Figure 15:
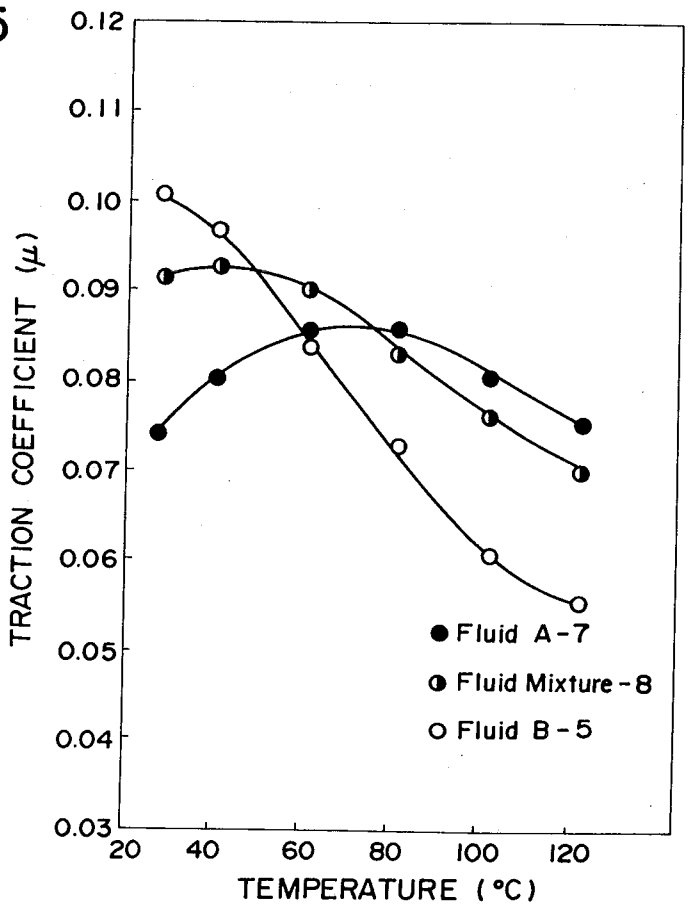

A mixed fluid, referred to as the Mixed Fluid 8 hereinbelow, was prepared by mixing the fluid obtained in Preparation 12, i.e. a mixture of 1-(1-dimethyl decahydronaphthyl)-1-cyclohexyl ethane and 1-(2-dimethyl decahydronaphthyl)-1-cyclohexyl ethane, referred to as the Fluid A-7 hereinbelow, and the Fluid B-5 obtained in Preparation 9 in a mixing ratio (Fluid A-7):(Fluid B-5) of 7:3 by weight. Several properties of this Mixed Fluid 8 are shown in Table 8. The traction coefficient of the Mixed Fluid 8 is shown in FIG. 15 as a function of temperature. FIG. 16 shows the traction coefficient of mixtures of the Fluids A-7 and B-5 in varied proportions at 60° C. as a function of the mixing ratio.

COMPARATIVE EXAMPLE 12

Table 8 also shows the properties of the Fluid A-7 obtained in Preparation 12 and the traction coefficient of the same is shown in FIG. 15 as a function of temperature. Table 7 and FIG. 15 also include the data for the Fluid B-5 already given in TAble 5 and FIG. 9, respectively, in order to facilitate comparison.

TABLE 8

| | Fluid | Kinematic Viscosity, cSt at 40° C. | Kinematic Viscosity, cSt at 100° C. | Viscosity index | Pour point, °C. |
|---|---|---|---|---|---|
| Example 8 | Mixed Fluid 8 | 37.52 | 4.406 | −92 | −35 |
| Comparative Example 12 | Fluid A-7 | 79.51 | 5.592 | −175 | −12.5 |
| Comparative Example 9 | Fluid B-5 | 11.82 | 2.722 | 48 | below −35 |

PREPARATION 13

Cumyl chloride was prepared by blowing dry hydrogen chloride gas into 590 g of α-methyl styrene at room temperature under agitation in a glass flask of 1 liter capacity. The yield of cumyl chloride was 750 g. In the next place, 2000 g of tetrahydronaphthalene and 70 g of titanium tetrachloride were introduced into a glass flask of 5 liters capacity and the mixture was chilled at 0° C. on an ice bath. Into the thus chilled mixture in the flask was added dropwise a mixture of 550 g of cumyl chloride and 300 g of tetrahydronaphthalene gradually over a period of 3 hours under agitation followed by further continued agitation for additional 1 hour to complete the reaction. The reaction mixture was processed in the same manner as in Preparation 8 and finally distilled under reduced pressure to give 400 g of a fraction boiling at 133° to 140° C. under a pressure of 0.03 mmHg. This fraction was identified by analysis to be 2-tetrahydronaphthyl-2-phenyl propane.

The thus obtained 2-tetrahydronaphthyl-2-phenyl propane in an amount of 400 g was introduced into an autoclave of 1 liter capacity together with 30 g of 5% ruthenium-carbon catalyst as used in Preparation 8 and the hydrogenation reaction was performed at 150° C. for 4 hours under a hydrogen pressure of 50 kg/cm$^2$. After cooling, the reaction mixture was processed in the same manner as in the proceding examples and the product was analyzed to find that 99.9% or more of the starting material had been hydrogenated and the product was identified to be 2-decahydronaphthyl-2-cyclohexyl propane, of which 90% and 10% of the molecules had the cis- and transisomeric structures, respectively, of the decahydronaphthyl rings.

EXAMPLE 9

Figure 17:
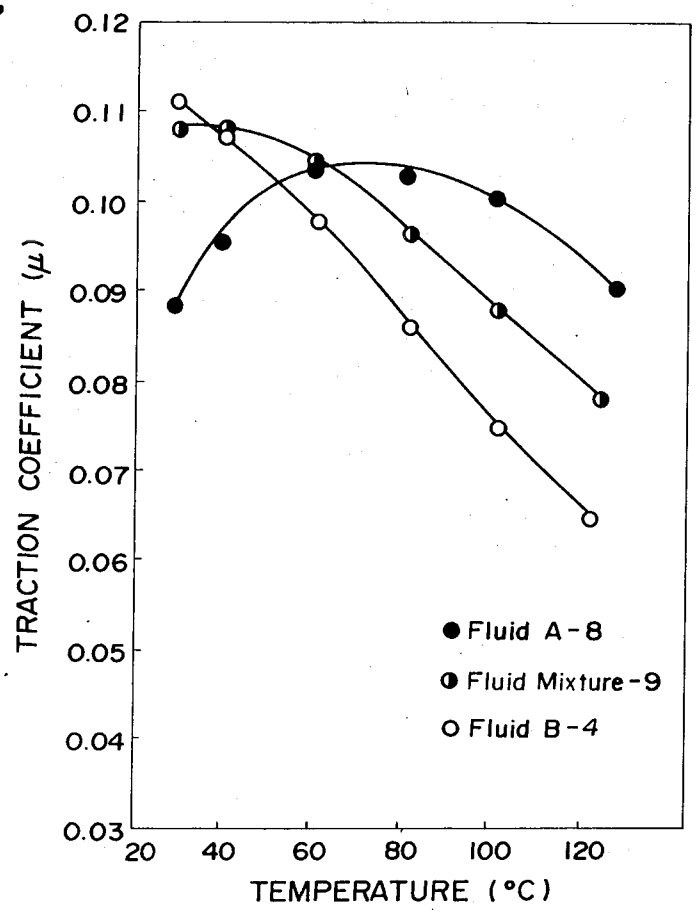
Figure 18:
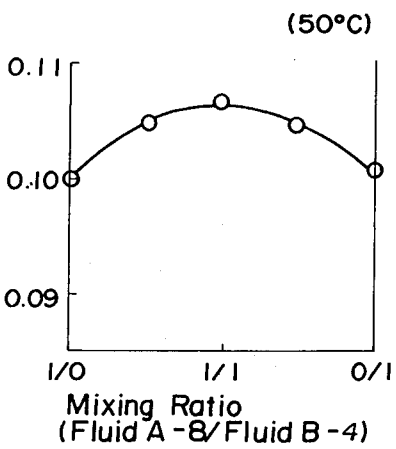

A mixed fluid, referred to as the Mixed Fluid 9 hereinbelow, was prepared by mixing the product obtained in Preparation 13, i.e. 2-decahydronaphthyl-2-cyclohexyl propane, referred to as the Fluid A-8 hereinbelow, and the Fluid B-4 obtained in Preparation 7 in a mixing ratio (Fluid A-8):(Fluid B-4) of 1:1 by weight. Several properties of this Mixed Fluid 9 are shown in Table 9 below. The traction coefficient of the Mixed Fluid 9 is shown in FIG. 17 as a function of temperature. Further, FIG. 18 shows the traction coefficient of mixtures of the Fluids A-8 and B-6 in varied portions at 50° C. as a function of the mixing ratio.

COMPARATIVE EXAMPLE 13

Table 9 also shows the properties of the Fluid A-8 obtained in Preparation 13 and FIG. 17 also shows the traction coefficient of the same as a function of temperature. Table 9 and FIG. 17 include the data for the Fluid B-4 already given in Table 4 and FIG. 7, respectively, to facilitate comparison.

TABLE 9

| | Fluid | Kinematic Viscosity, cSt at 40° C. | Kinematic Viscosity, cSt at 100° C. | Viscosity index | Pour point, °C. |
|---|---|---|---|---|---|
| Example 9 | Mixed Fluid 9 | 38.93 | 4.785 | −24 | −35.0 |
| Comparative Example 13 | Fluid A-8 | 131.3 | 7.669 | −106 | −7.5 |
| Comparative Example 7 | Fluid B-4 | 16.47 | 3.208 | 23 | below −35 |

EXAMPLE 10

Figure 19:
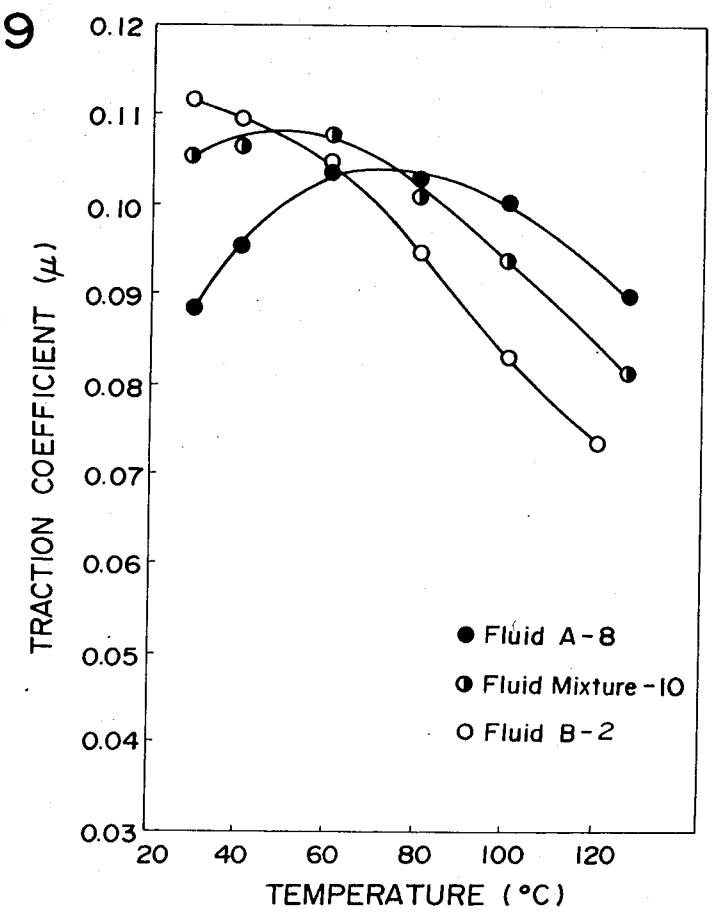
Figure 20:
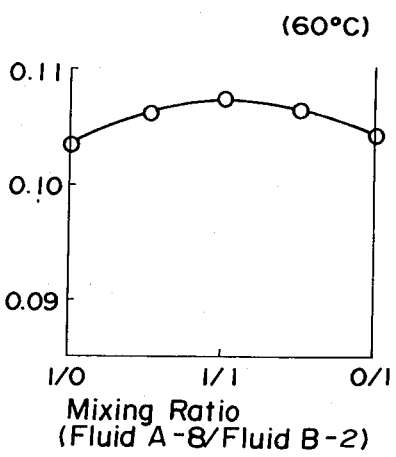

A mixed fluid, referred to as the Mixed Fluid 10 hereinbelow, was prepared by mixing the fluid obtained in Preparation 13, referred to as the Fluid A-8 hereinbelow, and the product obtained in Preparation 3, i.e. 2,4-dicyclohexyl-2-methyl pentane, referred to as the Fluid B-2 hereinbelow, in a mixing ratio (Fluid A-8):(Fluid B-2) of 1:1 by weight. Several properties of this Mixed Fluid 10 are shown in Table 10 below. The traction coefficient of the Mixed Fluid 10 is shown in FIG. 19 as a function of temperature. FIG. 20 shows the traction coefficient of mixtures of the Fluids A-8 and B-2 in varied proportions at 60° C. as a function of the mixing ratio.

Table 10 and FIG. 19 include the data for the Fluid A-8 and B-2, in order to facilitate comparison.

TABLE 10

| | Fluid | Kinematic Viscosity, cSt at 40° C. | Kinematic Viscosity, cSt at 100° C. | Viscosity index | Pour point, °C. |
|---|---|---|---|---|---|
| Example 10 | Mixed Fluid 10 | 46.22 | 5.085 | −36 | −35.0 |
| Comparative Example 13 | Fluid A-8 | 131.3 | 7.699 | −106 | −7.5 |
| Comparative Example 3 | Fluid B-2 | 20.27 | 3.580 | 13 | below −35 |

EXAMPLE 11

Figure 21:
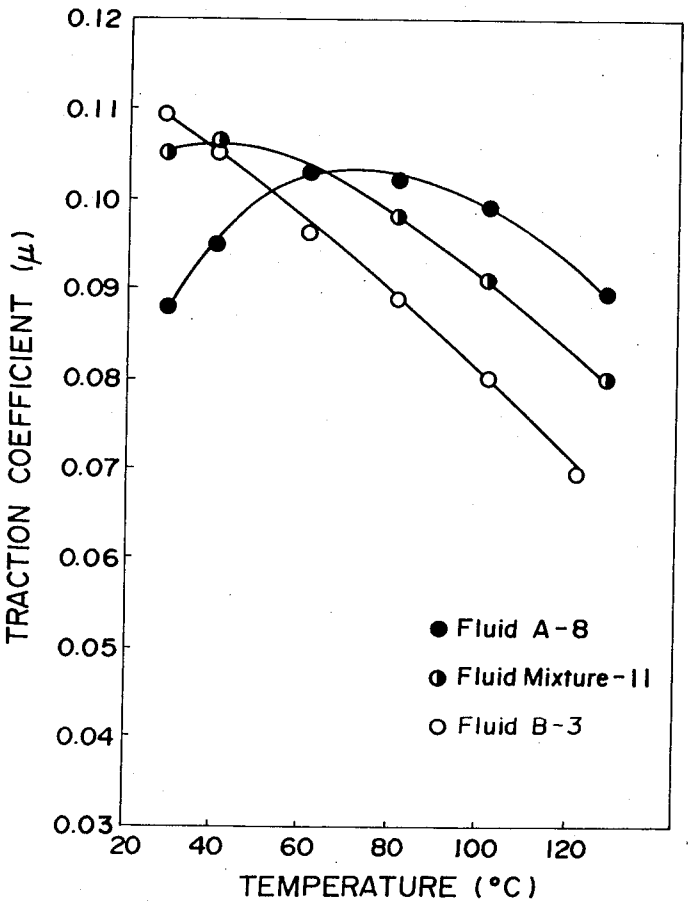
Figure 22:
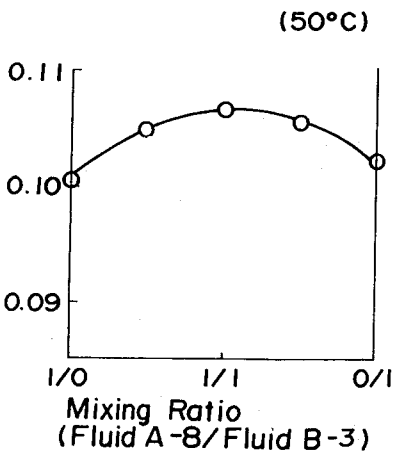

A mixed fluid, referred to as the Mixed Fluid 11 hereinbelow, was prepared by mixing the Fluid A-8 obtained in Preparation 13 and the product of Preparation 5, i.e. 1,3-dicyclohexyl-1-methyl cyclopentane, referred to as the Fluid B-3 hereinbelow, in a mixing ratio (Fluid A-8):(Fluid B-3) of 1:1 by weight. Several properties of this Mixed Fluid 11 are shown in Table 11 below. The traction coefficient of the Mixed Fluid 11 is shown in FIG. 21 as a function of temperature. Further, FIG. 22 shows the traction coefficient of mixtures of the Fluids A-8 and B-3 in varied proportions at 50° C. as a function of the mixing ratio.

Table 11 and FIG. 21 include the data for the Fluid A-8 and B-3, in order to facilitate comparison.

TABLE 11

| | Fluid | Kinematic Viscosity, cSt at 40° C. | Kinematic Viscosity, cSt at 100° C. | Viscosity index | Pour point, °C. |
|---|---|---|---|---|---|
| Example 11 | Mixed Fluid 11 | 48.31 | 5.283 | −22 | −35.0 |
| Comparative Example 13 | Fluid A-8 | 131.3 | 7.699 | −106 | −7.5 |
| Comparative Example 5 | Fluid B-3 | 21.15 | 3.798 | 38 | below −35 |

EXAMPLE 12

Figure 23:
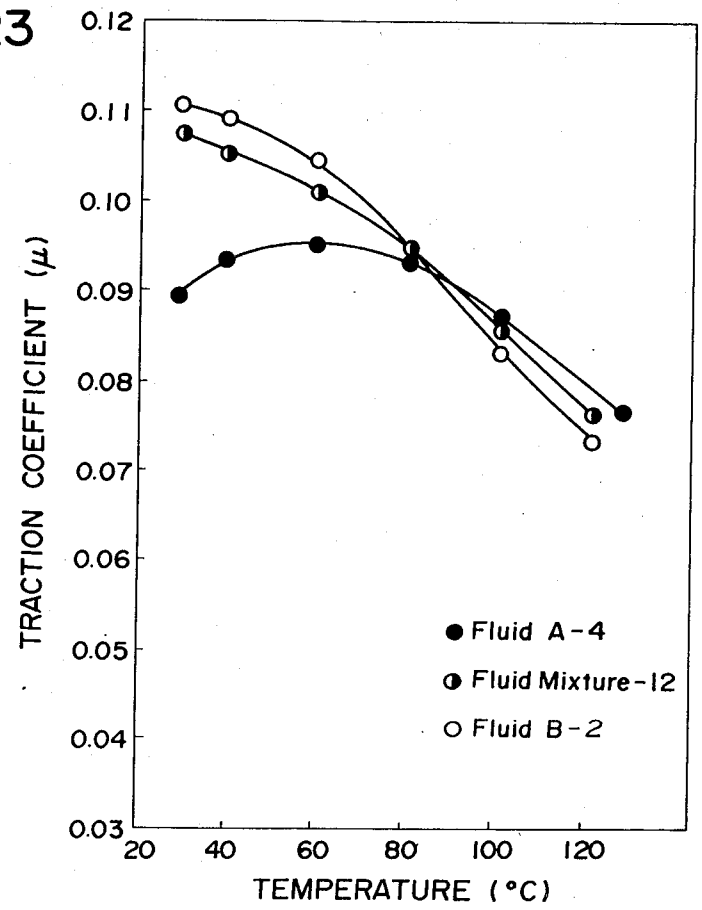
Figure 24:
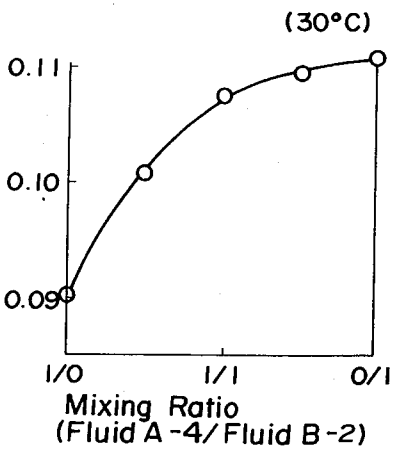

A mixed fluid, referred to as the Mixed Fluid 12 hereinbelow, was prepared by mixing the Fluid A-4 obtained in Preparation 8 and the Fluid B-2 obtained in Preparation 3 in a mixing ratio (Fluid A-4):(Fluid B-2) of 1:1 by weight. Several properties of this Mixed Fluid 12 are shown in Table 12. The traction coefficient of the Mixed Fluid 12 is shown in FIG. 23 as a function of temperature. Further, FIG. 24 shows the traction coefficient of mixtures of the Fluids A-4 and B-2 in varied proportions at 30° C. as a function of the mixing ratio. Table 12 and FIG. 23 include the data for the Fluids A-4 and B-2 in order to facilitate comparison.

TABLE 12

| | Fluid | Kinematic Viscosity, cSt at 40° C. | Kinematic Viscosity, cSt at 100° C. | Viscosity index | Pour point, °C. |
|---|---|---|---|---|---|
| Example 12 | Mixed Fluid 12 | 29.80 | 4.268 | −16 | −35.0 |
| Comparative Example 8 | Fluid A-4 | 42.60 | 4.884 | −41 | −20.0 |
| Comparative Example 3 | Fluid B-2 | 20.27 | 3.580 | 13 | below −35 |

PREPARATION 14

Into a four-necked glass flask of 1 liter capacity equipped with a stirrer, reflux condenser with a drier tube of calcium chloride, thermometer and gas inlet tube were introduced 591 g (5 moles) of α-methyl styrene, 2.8 g (0.05 mole) of potassium tert-butoxide and 3.7 g (0.05 mole) of tert-btuyl alcohol to form a reaction mixture, which was heated at 148° C. for 22 hours under agitation while argon gas was introduced into the flask through the gas inlet tube at a rate of 10 ml/minute. After cooling, introduction of argon gas was discontinued and the reaction mixture was transferred to a distillation still and distilled under reduced pressure to remove the unreacted α-methyl styrene. After cooling, the fluid left in the distillation still was added to a glass-made separation funnel of 1 liter capacity containing 250 ml of water. Further, 300 ml of ether were added to the separation funnel which was shaken and kept standing to effect phase separation. The aqueous phase was discarded out of the separation funnel and the ether solution was washed twice each with 250 ml of water followed by drying over anhydrous sodium sulfate. The ether solution was then distilled to remove the ether and the residue was distilled under reduced pressure to give 65 g of 1,4-dimethyl-4-phenyl-1,2,3,4-tetrahydronaphthalene boiling at 135° to 137° C. under a pressure of 0.2 mmHg. This product had a purity of 96% and the above mentioned yield was 11% of the theoretical value.

In the next place, a 59.1 g (0.25 mole) portion of the above obtained 1,4-dimethyl-4-phenyl-1,2,3,4-tetrahydronaphthalene was introduced into a stainless steel-made autoclave of 1 liter capacity equipped with an electromagnetic stirrer together with 200 ml of methyl cyclohexane and 3 g of the same nickel catalyst for hydrogenation as used in Preparation 2 and the hydrogenation reaction was performed at 200° C. for 2 hours under a hydrogen pressure of 50 atmospheres. After completion of the reaction, the reaction mixture was filtered to remove the catalyst and the filtrate was combined with the washing of the catalyst obtained by use of 50 ml of methyl cyclohexane as the washing liquid. The solution was freed from the methyl cyclohexane on a rotary evaporator to give 58.9 g of 1-cyclohexyl-1,4-dimethyl decahydronaphthalene as a product in a yield of 96% of the theoretical value.

EXAMPLE 13

Figure 25:
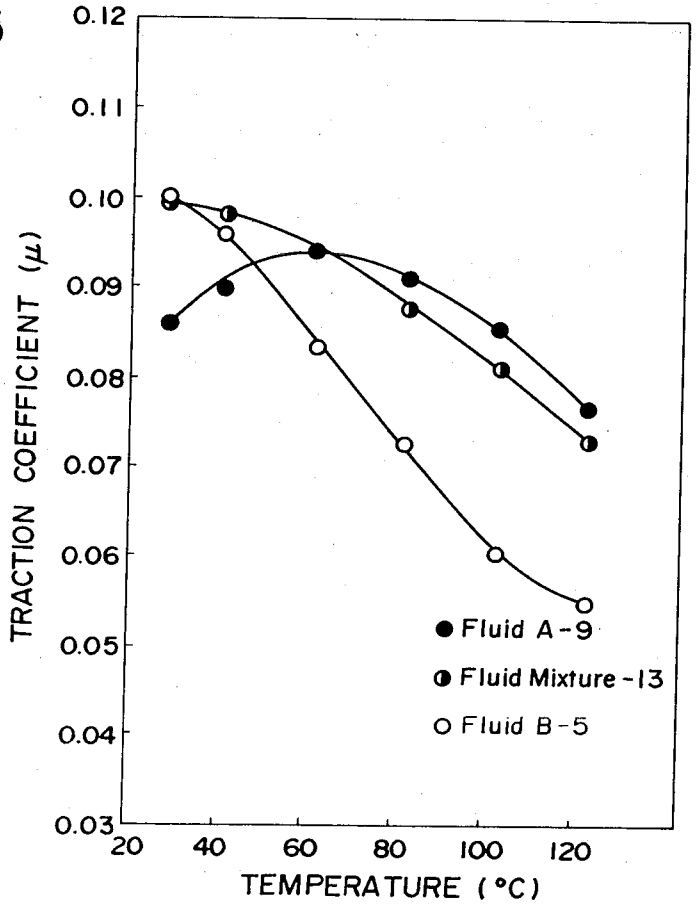
Figure 26:
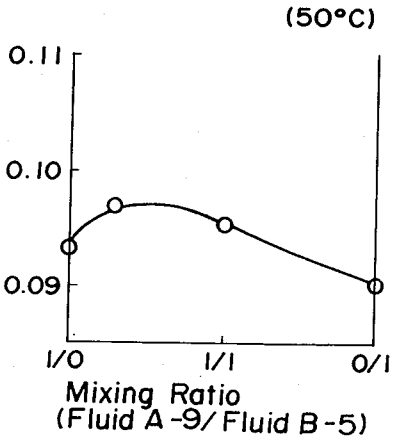

A mixed fluid, referred to as the Mixed Fluid 13 hereinbelow, was prepared by mixing the product of Preparation 14, i.e. 1-cyclohexyl-1,4-dimethyl decahydronaphthalene, referred to as the Fluid A-9 hereinbelow, and the Fluid B-5 obtained in Preparation 9 in a mixing ratio (Fluid A-9):(Fluid B-5) of 85:15 by weight. Several properties of this Mixed Fluid 13 are shown in Table 13 below. The traction coefficient of the Mixed Fluid 13 is shown in FIG. 25 as a function of temperature. Further, FIG. 26 shows the traction coefficient of mixtures of the Fluids A-9 and B-5 in varied proportions at 50° C. as a function of the mixing ratio.

COMPARATIVE EXAMPLE 14

Table 13 also shows the properties of the Fluid A-9 obtained in Preparation 14 and FIG. 25 also shows the traction coefficient of the same as a function of temperature. Table 13 and FIG. 25 include the data for the Fluid B-5.

TABLE 13

| | Fluid | Kinematic Viscosity, cSt at 40° C. | Kinematic Viscosity, cSt at 100° C. | Viscosity index | Pour point, °C. |
|---|---|---|---|---|---|
| Example 13 | Mixed Fluid 13 | 28.54 | 4.229 | −6 | below −35 |
| Comparative Example 14 | Fluid A-9 | 37.02 | 4.504 | −61 | −22.5 |
| Comparative Example 9 | Fluid B-5 | 11.82 | 2.722 | 48 | below −35 |

What is claimed is:

1. A working fluid for traction drive which comprises:

(A) a first compound selected from the class consisting of (A-1) bis(decahydronaphthalene) compounds having two decahydronaphthalene rings in a molecule directly bonded to each other, (A-2) alkane compounds having two decahydronaphthalene rings in a molecule bonded to one and the same carbon atom of the alkane, (A-3) alkane compounds having two decahydronaphthalene rings in a molecule bonded to two carbon atoms of the alkane adjacent to each other, (A-4) alkane compounds having a decahydronaphthalene ring and a cyclohexane ring in a molecule bonded to one and the same carbon atom of the alkane, and (A-5) cyclohexyl decahydronaphthalene compounds; and (B) a second compound selected from the class consisting of (B-1) alkane compounds having a main chain of two or three carbon atoms, to which at least two methyl groups are bonded, and having two cyclohexane rings in a molecule each bonded to one of the terminal carbon atoms of the alkane, and (B-2) cyclopentane compounds having two cyclohexane rings in a molecule;

as the principal constituents, the fluid having a kinematic viscosity of at least 3 centistokes at 100° C.

2. The working fluid for traction drive as claimed in claim 1 in which the amount of the second compound as the component (B) is in the range from 10 to 900 parts by weight per 100 parts by weight of the first compound as the component (A).

3. The working fluid for traction drive as claimed in claim 1 in which the bis(decahydronaphthalene) compound as the component (A-1) is a compound represented by the general formula

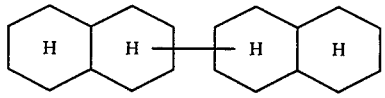

4. The working fluid for traction drive as claimed in claim 1 in which the alkane compound as the component (A-2) is a compound represented by the general formula

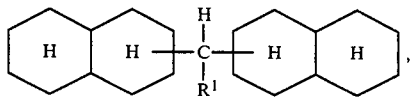

in which $R^1$ is a hydrogen atom or an alkyl group having 1 to 3 carbon atoms.

5. The working fluid for traction drive as claimed in claim 1 in which the alkane compound as the component (A-3) is a compound represented by the general formula

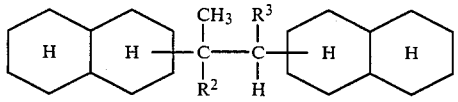

in which $R^2$ and $R^3$ are each a hydrogen atom or a methyl group.

6. The working fluid for traction drive as claimed in claim 1 in which the alkane compound as the component (A-4) is a compound represented by the general formula

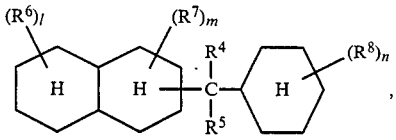

in which $R^4$, $R^5$, $R^6$ and $R^7$ are each a hydrogen atom or a methyl group, $R^8$ is a hydrogen atom or an alkyl group having 1 to 4 carbon atoms and the subscripts l, m and n are each a positive integer of 1, 2 or 3.

7. The working fluid for traction drive as claimed in claim 1 in which the cyclohexyl decahydronaphthalene compound as the component (A-5) is a compound represented ty the general formula

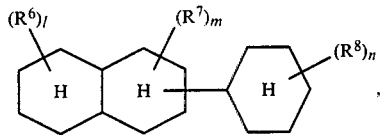

in which $R^6$ and $R^7$ are each a hydrogen atom or a methyl group, $R^8$ is a hydrogen atom or an alkyl group having 1 to 4 carbon atoms and the subscripts l, m and n are each a positive integer of 1, 2 or 3.

8. The working fluid for traction drive as claimed in claim 1 in which the alkane compound as the component (B-1) having two carbon atoms in a molecule is a compound represented by the general-formula

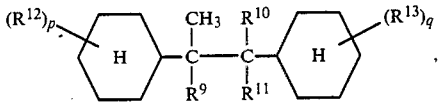

in which $R^9$, $R^{10}$, $R^{11}$, $R^{12}$ and $R^{13}$ are each a hydrogen atom or a methyl group, at least one of $R^9$, $R^{10}$ and $R^{11}$ being a methyl group, and the subscripts p and q are each a positive integer of 1, 2 or 3.

9. The working fluid for traction drive as claimed in claim 1 in which the alkane compound as the component (B-1) having three carbon atoms in a molecule is a compound represented by the general formula

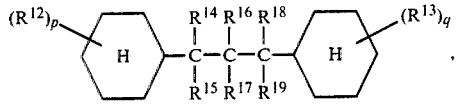

in which $R^{12}$, $R^{13}$, $R^{14}$, $R^{15}$, $R^{16}$, $R^{17}$, $R^{18}$ and $R^{19}$ are each a hydrogen atom or a methyl group, at least two of $R^{14}$, $R^{15}$, $R^{16}$, $R^{17}$, $R^{18}$ and $R^{19}$ being methyl groups, and the subscripts p and q are each a positive integer of 1, 2 or 3.

10. The working fluid for traction drive as claimed in claim 1 in which the cyclopentane compound as the component (B-2) is a compound represented by the general formula

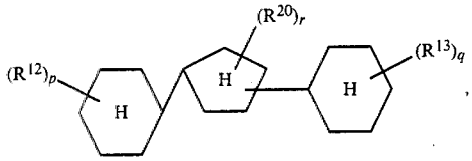

in which $R^{12}$, $R^{13}$ and $R^{20}$ are each a hydrogen atom or a methyl group and the subscripts p, q and r are each a positive integer of 1, 2 or 3.

* * * * *